US012252221B2

(12) United States Patent
Willis et al.

(10) Patent No.: US 12,252,221 B2
(45) **Date of Patent: *Mar. 18, 2025**

(54) COLLAPSIBLE WATERCRAFT

(71) Applicant: Oru Kayak, Inc., Emeryville, CA (US)

(72) Inventors: Anton Willis, Oakland, CA (US); Forrest Nelson Harvey, Oakland, CA (US)

(73) Assignee: ORU KAYAK, INC., Emeryville, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/529,966

(22) Filed: Dec. 5, 2023

(65) Prior Publication Data

US 2024/0116604 A1 Apr. 11, 2024

Related U.S. Application Data

(63) Continuation of application No. 18/149,597, filed on Jan. 3, 2023, now Pat. No. 11,834,138, which is a continuation of application No. 16/874,311, filed on May 14, 2020, now Pat. No. 11,541,971.

(60) Provisional application No. 62/847,461, filed on May 14, 2019.

(51) Int. Cl.
*B63B 34/23* (2020.01)

(52) U.S. Cl.
CPC ..... *B63B 34/23* (2020.02)

(58) Field of Classification Search
CPC ..... B63B 34/20; B63B 34/21; B63B 34/23; B63B 34/26; B63B 7/00; B63B 2007/003; B63B 7/02; B63B 7/04; B63B 7/06
USPC ..... 114/343, 347, 352, 353, 354, 355, 363, 114/364
See application file for complete search history.

(56) References Cited

U.S. PATENT DOCUMENTS 5,184,565 A * 2/1993 Matthews ..... B63B 7/06 D12/300
8,783,204 B1 * 7/2014 Herold ..... B63B 34/23 114/352

* cited by examiner

*Primary Examiner* — Daniel V Venne
(74) *Attorney, Agent, or Firm* — KOLITCH ROMANO DASCENZO GATES LLC

(57) ABSTRACT

A collapsible kayak may include a single-piece hull including a plurality of crease lines along which the hull is foldable. A floorboard lines a midship portion of the hull between a bow portion and a stern portion, and the floorboard includes a base and a pair of outboard walls permanently fixed at distal ends to port and starboard gunwales of the hull. The bow, stern, and midship portions are configured as a tri-fold, such that the bow portion and the stern portion of the kayak are foldable toward each other to overlap the midship portion of the hull when collapsed.

20 Claims, 21 Drawing Sheets

COLLAPSIBLE WATERCRAFT

CROSS-REFERENCES

The following applications and materials are incorporated herein, in their entireties, for all purposes: U.S. Provisional Patent Application Ser. No. 62/847,461, filed May 14, 2019; and U.S. patent application Ser. No. 16/874,311, filed May 14, 2020.

FIELD

This disclosure relates to systems and methods for collapsible watercraft. Specifically, this disclosure relates to foldable kayaks.

INTRODUCTION

Kayaks and other lightweight, personal watercraft are popular for recreational use on rivers, lakes, oceans, and other suitable locations. Collapsible watercraft may be especially convenient in at least some cases due to the ease with which they can be transported and stored. For example, a foldable kayak may be folded into a relatively small configuration when not in use on the water. In the folded state, the foldable kayak is less cumbersome to carry than a conventional kayak and requires less space to store. Various aspects of the foldable kayak's design impact the ease of assembling the kayak, the robustness of the assembled kayak, and the suitability of the kayak for different types of use. Types of use may include, for example, kayaking with different numbers of passengers, or during activities requiring use and/or storage of equipment (e.g., photography, fishing, hunting, etc.).

SUMMARY

The present disclosure provides systems, apparatuses, and methods relating to collapsible watercraft.

In some embodiments, a collapsible watercraft (e.g., a kayak) may include: a single-piece hull including a plurality of crease lines along which the hull is foldable; and a floorboard lining a midship portion of the hull between a bow portion and a stern portion, the floorboard including a base and a pair of outboard walls pivotably coupled to the base and permanently fixed at distal ends to port and starboard gunwales of the hull, respectively; wherein the bow, stern, and midship portions are configured as a tri-fold, such that the bow portion and the stern portion of the kayak are foldable toward each other to overlap the midship portion of the hull when collapsed.

In some embodiments, a collapsible watercraft may include: a hull having a plurality of creases at which the hull is foldable to selectively deploy and collapse the watercraft; a closed prow at a bow end of the hull and a closed transom at a stern end of the hull; and an integrated floorboard disposed at a midship section of the hull, at least a portion of the floorboard being permanently fixed to the hull; wherein the bow end and the stern end are foldable at respective creases forward and aft of the floorboard to overlap the midship section such that the closed prow and closed transom nest together over the floorboard.

In some embodiments, a method of using a collapsible kayak may include: releasing one or more temporary fasteners holding a collapsible kayak in a deployed configuration to cause port and starboard gunwales of the kayak to be moveable in an outboard direction, wherein the kayak has a midship section including an integrated floorboard fixed to an outer hull of the kayak at the port and starboard gunwales; folding a first end of the hull of the kayak at a first crease toward a second end of the hull, such that the first end overlaps the integrated floorboard; and folding the second end of the hull at a second crease to overlap the first end of the hull.

Features, functions, and advantages may be achieved independently in various embodiments of the present disclosure, or may be combined in yet other embodiments, further details of which can be seen with reference to the following description and drawings.

DETAILED DESCRIPTION

Figure 1:
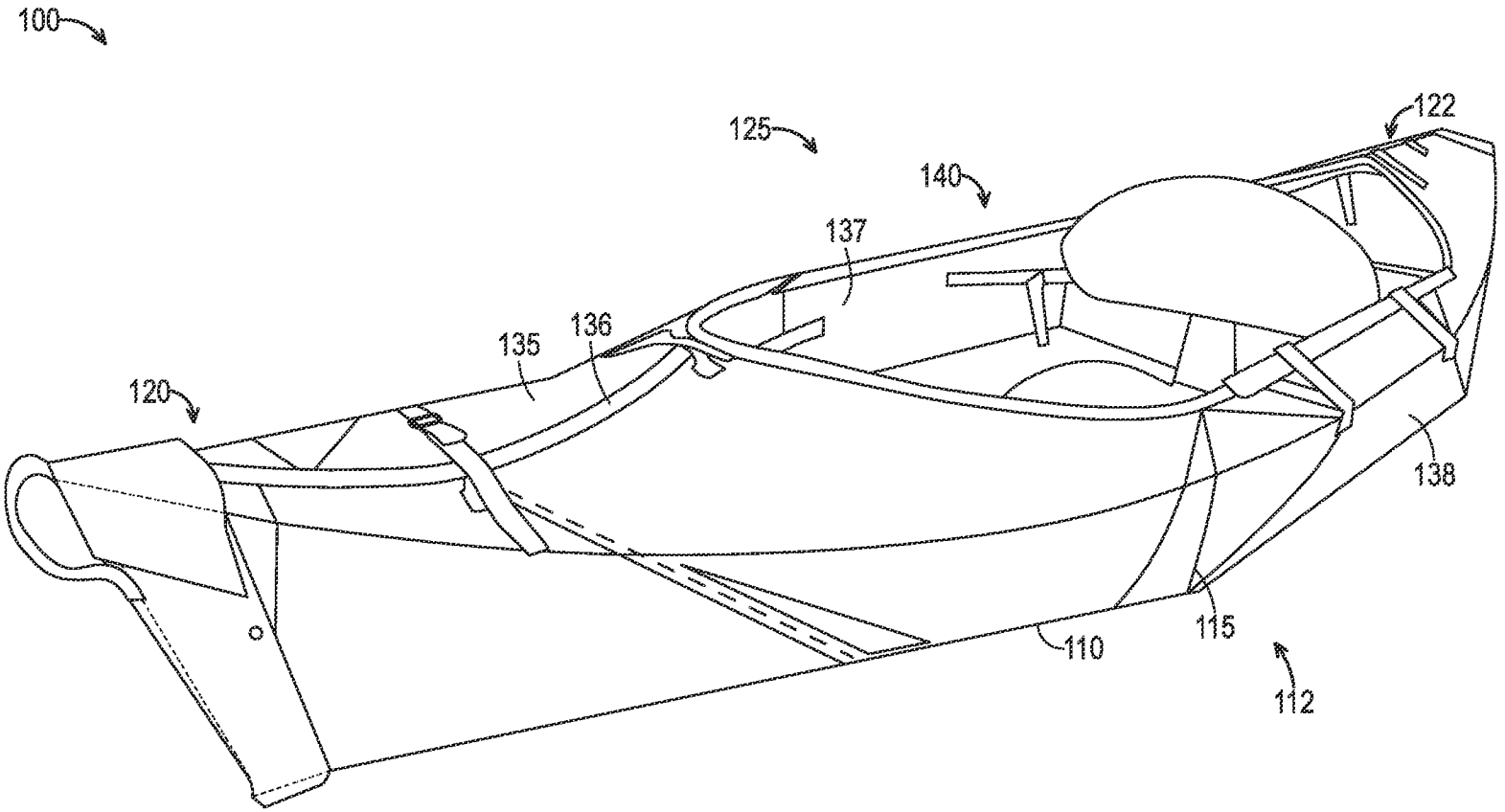
FIG. 1 is a perspective view of an illustrative collapsible watercraft in a deployed state.

Various aspects and examples of a collapsible watercraft, as well as related methods, are described below and illustrated in the associated drawings. Unless otherwise specified, a watercraft in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

The terms "inboard," "outboard," "forward," "rearward," and the like are intended to be understood in the context of a watercraft and/or of a host watercraft on which systems described herein may be mounted or otherwise attached. For example, "outboard" may indicate a relative position that is laterally farther from the centerline of the watercraft, or a direction that is away from the watercraft centerline. Conversely, "inboard" may indicate a direction toward the centerline, or a relative position that is closer to the centerline. Similarly, "forward" and "fore" mean toward the front portion of the watercraft (e.g., the bow), and "aft" means toward the rear of the watercraft (e.g., the stern). In the absence of a host watercraft, the same directional terms may be used as if the watercraft were present. For example, even when viewed in isolation, a device may have a "forward" edge, based on the fact that the device would be installed with the edge in question facing in the direction of the bow of the host watercraft.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, a collapsible watercraft in accordance with the present teachings comprises a sheet-like hull having a plurality of pre-defined creases and configured to transition between a stowed state and a deployed (or assembled) state by folding or unfolding along a plurality of predefined fold lines. In the stowed state, the foldable sheet of the watercraft may form a self-contained, portable carrying case, which is more convenient to transport that a conventional watercraft. In the deployed state, the foldable sheet forms a body (e.g., a hull, deck, and/or sides) of the watercraft. The body includes a midship portion of the watercraft defining a cockpit. While other watercraft topologies (such as canoes) may be utilized, the examples shown and described herein are in the form of kayaks.

Opposing ends (i.e., a bow end and stern end) of the foldable sheet are permanently closed to form a three-dimensional prow and transom of the kayak. The foldable sheet is therefore configured such that the prow and transom of the watercraft at least generally retain their shapes in both the deployed state and the stowed state. The kayak may include a fairing (e.g., rigid fairing, tape fairing, etc.) configured to cover portions of the bow and stern, e.g., to protect the watercraft from damage.

The collapsible kayak of the present disclosure includes at least one floorboard permanently coupled to the cockpit. The floorboard provides structural support to the kayak and provides a mechanism for attaching and supporting one or more passenger seats. The floorboard is configured to support midship side portions of the hull, such that when in the stowed state, the floorboard forms an accommodation space to hold portions of the foldable sheet as well as accessories (e.g., seat, paddles, etc.).

The floorboard includes a base having a middle portion coupled to a pair of outboard portions (e.g., via predefined creases). A pair of lateral walls of the floorboard are pivotably coupled at proximal ends to the base, and fixed at distal ends to the port and starboard gunwales. In some examples, the floorboard includes additional creases and/or darts enabling it to at least partially conform to the shape of the kayak hull. In some examples, the watercraft may include more than one floorboard, either identical or different. For example, each of the floorboards may be creased in a different manner (e.g., to facilitate conforming to different portions of the watercraft body, and/or to achieve respective shapes that conform to the body to different extents).

The lateral walls of the floorboard(s) are configured to be permanently attached to the gunwales of the midship side portions of the watercraft via one or more respective engagement members. Each of the engagement members includes an elongated clamp extending fore and aft (e.g., longitudinally) along a side of the cockpit. The engagement members may be fixed to the floorboard and configured to selectively engage the foldable sheet, or fixed to the foldable sheet and configured to selectively engage the floorboard. In some examples, the engagement members are permanently installed (e.g., pinned in place), such that the lateral walls of the floorboard cannot be disengaged from the gunwale of the cockpit without causing damage. Fixing the floorboard to the gunwales facilitates the formation of the accommodation space (mentioned above) when the watercraft is in the stowed state.

In some examples, the engagement members are configured to receive an attachment portion of an accessory for the watercraft. For example, the engagement members may have a longitudinal channel shaped to receive a fastener that retains an accessory (e.g., a spare paddle) against the profile of the hull.

The floorboard may include one or more seat attachment devices configured to releasably secure a seat, or component of a seat, to the floorboard, and a user may install one (or more) seats as desired. Suitable attachment devices may include slots, clamps, threaded bores, and/or other suitable receptacles configured to receive a complementary attachment portion of a removable seat.

In some examples, each seat includes a seatback and a separate seating surface, and installing the seat in the watercraft includes independently attaching the seatback and the seating surface to the appropriate floorboard device. For example, the seatback may include a tab configured to be received in a slot in the floorboard, and the seating surface may be configured to be retained against the floorboard by an elastic cord.

In some examples, the collapsible kayak includes one or more bulkheads oriented athwartships and configured to close off one end of the watercraft. These bulkheads may include a single expanse held in place by a tether. In some examples, each bulkhead includes two half-bulkheads pivotably connected to the hull, and configured to separate and fold against the hull when the watercraft is in the stowed state. In some examples, each half-bulkhead has a corresponding engagement mechanism (e.g., Velcro, snaps, zipper, etc.) configured to join the half-bulkheads together to form a single bulkhead.

In some examples, a foldable edge portion of the foldable sheet is configured to form portions of the gunwale. In some examples, the foldable edge forms the gunwale at the forward end of the cockpit. The foldable edge may be configured to reinforce the cockpit and/or increase the freeboard of the watercraft as compared with other designs.

As mentioned above, the collapsible watercraft may be a kayak. In some embodiments, the collapsible watercraft may comprise a canoe, a rowboat, a raft or rafting boat, and/or any other suitable non-motorized or motorized watercraft.

Examples, Components, and Alternatives

The following sections describe selected aspects of illustrative collapsible watercraft, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Foldable Kayak

As shown in FIGS. 1-28, this section describes an illustrative collapsible kayak 100, which is an example of the collapsible watercraft described above.

Figure 2:
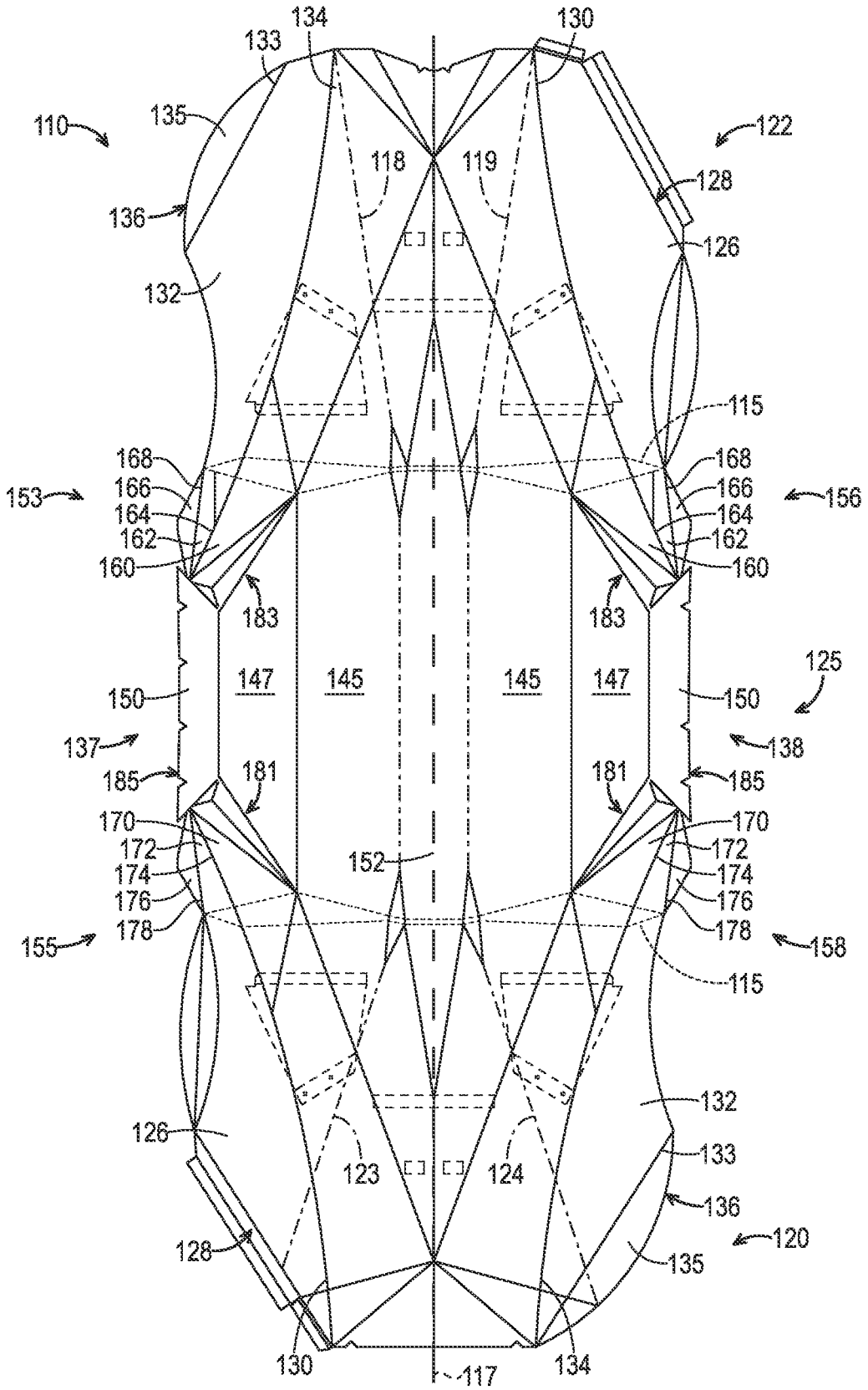
FIG. 2 is a top plan view of a flexible skin of the watercraft of FIG. 1.

FIG. 1 depicts kayak 100 in a deployed configuration, with a foldable sheet 110 folded into a kayak body 112. FIG. 2 depicts foldable sheet 110 (also referred to as a skin, a main panel, or a hull), which is an example of the foldable sheet described above, depicted in a flattened configuration for simplicity of explanation. However, as described below, foldable sheet 110 may include permanently closed end portions (i.e., prow and transom), which are not shown in FIG. 2.

Foldable sheet 110 is made of a strong material suitable for deployment in a body of water and having a plurality of predefined fold lines 115, also referred to as creases or living hinges. Fold lines 115 comprise creases along which foldable sheet 110 is configured to fold. Suitable materials for foldable sheet 110 may include, for example, hollow-core sheets of corrugated and/or honeycomb polypropylene and/or polyethylene, although other waterproof, resilient materials may be used. Foldable sheet 110 is configured to be assembled (e.g., to form kayak 100) by folding along fold lines 115. In the assembled state (AKA the deployed state), foldable sheet 110 forms body 112 (also referred to as the hull) of kayak 100. Foldable sheet 110 defines a longitudinal axis 117.

As shown in FIG. 1, kayak 100 has a front or bow portion 120, a rear or stern portion 122, and a midship portion 125 extending between the bow and stern portions. Portions of foldable sheet 110 corresponding to bow portion 120, stern portion 122, and midship portion 125 of the assembled kayak are indicated in FIG. 2. Bow portion 120 and stern portion 122 each include a first deck panel 126 defined between an edge 128 of foldable sheet 110 and a fold line 130 in the foldable sheet. Bow portion 120 and stern portion 122 each further include a second deck panel 132 opposing the corresponding first deck panel 126. Second deck panels 132 each are substantially defined between two fold lines 133 and 134. A respective curved deck panel 135 is connected to each second deck panel 132 at fold line 134.

As shown in FIG. 1, when kayak 100 is in the deployed state, first deck panel 126 and second deck panel 132 in both the bow portion and the stern portion are brought together such that curved deck panel 135 at least partially overlaps the first deck panel. Straps and buckles attached to the first deck panels, second deck panels, and/or curved deck panels extend over the curved deck panels to releasably secure the curved deck panel to the first deck panel. A resilient edge fitting 136 attached to edges of curved deck panel 135 and first deck panel 126 is compressed when the straps hold the deck panels together, forming a substantially water-tight seal. The overlap of curved deck panel 135 and first deck panel 126 allows each of the bow and stern portions of the kayak to be formed without precisely aligning any edges of foldable sheet 110, thereby increasing the ease of assembly of the kayak.

In kayak 100, curved deck panel 135 of bow portion 120 is disposed on a starboard edge of foldable sheet 110, and curved deck panel 135 of stern portion 122 is disposed on a port edge of the foldable sheet. In other examples, the bow end curved deck panel may extend from the port edge and the stern end curved deck panel may extend from the starboard edge, or the curved deck panels may both extend from the starboard or port edge of the sheet.

Midship portion 125 includes a pair of opposing midship side portions 137, 138 defining between them a cockpit 140. Each midship side portion 137, 138 includes a midship outer panel 145 (see FIG. 2), a midship gunwale panel 147 connected to the midship outer panel at a fold line 148, and a midship cockpit flap 150 connected to the midship gunwale panel at a fold line 151. In the assembled state, outer panels 145 form outer walls of the kayak hull, gunwale panels 147 form gunwales of the kayak, and cockpit flaps 150 fold down into cockpit 140 toward a cockpit floor 152. Cockpit flaps 150 are configured to attach to the floorboard (s) of the kayak, as described in further detail below.

Midship side portion 137 further includes a rear midship portion 153 and a front midship portion 155, and midship side portion 138 includes a rear midship portion 156 and a front midship portion 158. Rear midship portions 153, 156 each include a rear outer panel 160, a rear gunwale panel 162 connected to the rear outer panel at a fold line 164, and a rear cockpit flap 166 connected to the rear gunwale panel at a fold line 168. Front midship portions 155, 158 each include a front outer panel 170, a front gunwale panel 172 connected to the front outer panel at a fold line 174, and a front cockpit flap 176 connected to the front gunwale panel at a fold line 178.

As shown in FIG. 2, a respective front tessellated section 181 connects each gunwale panel 147 to the corresponding front outer panel 170. A respective rear tessellated section 183 connects each gunwale panel 147 to the corresponding rear outer panel 160. The tessellated sections facilitate folding sheet 110 into the stowed state.

Resilient edge fittings 185 may be disposed along edges of midship cockpit flaps 150, rear cockpit flaps 166, and/or front cockpit flaps 176.

As shown in FIG. 1, when kayak 100 is in the assembled state, each set of fold lines 151, 168, and 178 form a substantially straight, contiguous line, such that cockpit 140 has substantially parallel edges all along the length of the cockpit, giving the cockpit a generally uniform width. In some examples, the cockpit width varies along the length.

Figure 3:
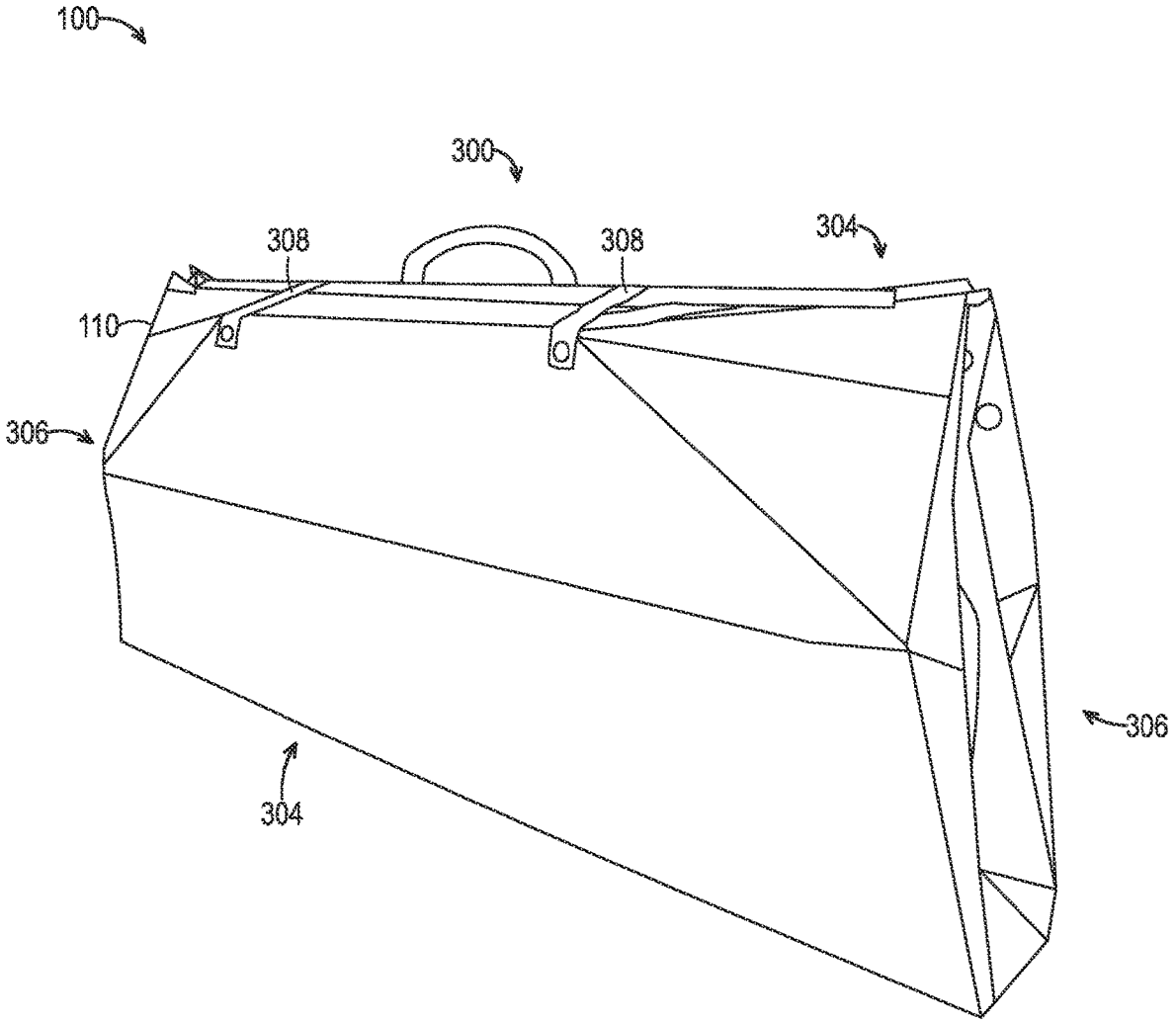
FIG. 3 is a perspective view of the watercraft of FIG. 1 in a stowed state.

FIG. 3 is a front isometric view of kayak 100 in a collapsed or stowed state. In the stowed state, foldable sheet 110 takes the form of a generally rectilinear box 300 or rectangular prism. Box 300 has two opposing sides 304, where foldable sheet 110 may be slightly bulged, and two opposing folded sides 306. Folded sides 306 correspond to folded portions of midship portion 125.

Two pairs of straps 308 disposed at the top of box 300 may be fastened (e.g., buckled) together to further secure foldable sheet 110 in the folded state. The straps may be buckled together with the straps slack and then tightened to compress box 300 to a more compact size.

When transitioning kayak 100 to the stowed state, components of seat assemblies, footrests, bulkheads, and/or any other suitable components of kayak 100 may be inserted into an accommodating space of box 300 (e.g., between folds of folded foldable skin 110). In some examples, accessories may be placed between the floorboard and the adjacent folded end of the kayak.

Figure 4:
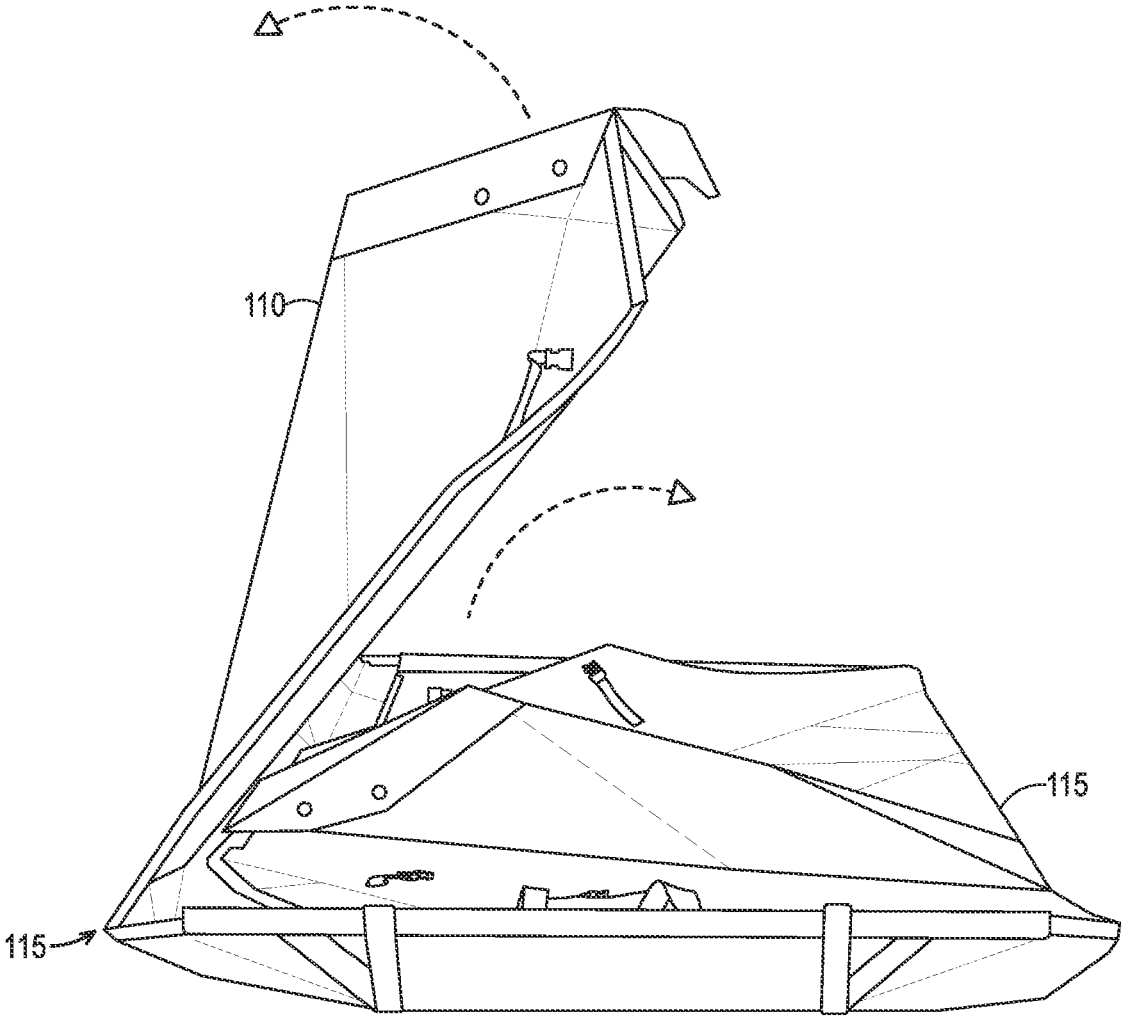
FIG. 4 is a perspective view of the watercraft of FIG. 1 in a partially folded state.

As shown in FIG. 4, to achieve the deployed state, straps 308 are unbuckled and foldable sheet 110 is unfolded along the predefined fold lines 115. First the bow portion of the kayak is unfolded along lines 115, then the stern portion is unfolded along the predefined fold lines 116, as indicated generally by the arrows in FIG. 4.

Figure 5:
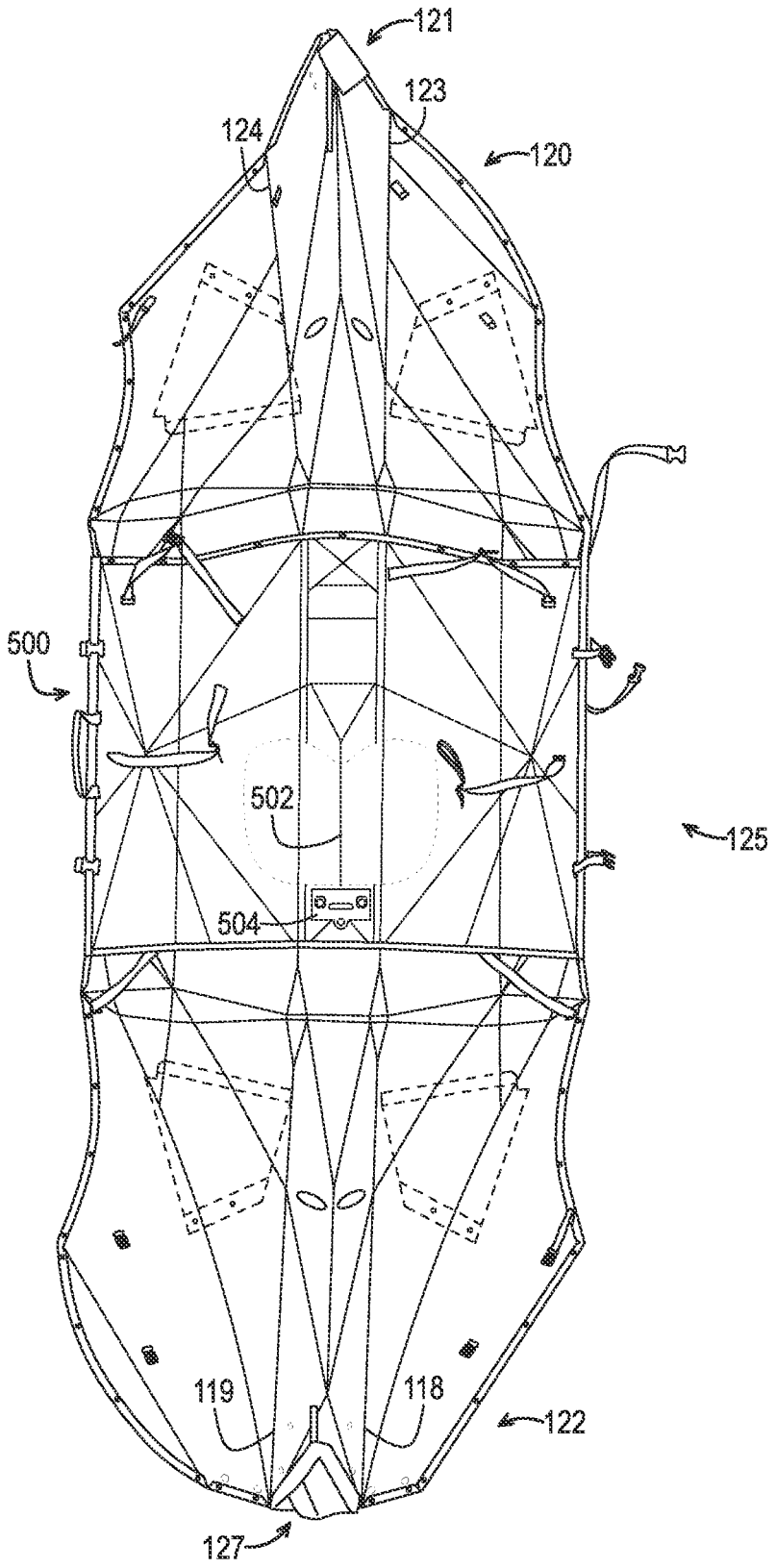
FIG. 5 is a top plan view of the flexible skin of FIG. 2 showing closed ends and a floorboard.

Turning now to FIG. 5, aft fold lines 118, 119 and forward fold lines 123, 124 are pressed in a downward direction, giving concavity to the skin and forming the hull of kayak 100. With continued reference to FIG. 5, prow 121 and a transom 127 of stern 122 are shown to be permanently folded and closed. This arrangement advantageously provides a water-tight finish to the bow and stern portions of the kayak. Further description of prow 121 and transom 127 is provided below.

As shown in FIG. 5, kayak 100 includes a floorboard 500. Floorboard 500 includes an elastic cord 502 extending longitudinally along a portion of the floorboard, e.g., in front of a seat receptacle 504. Elastic cord 502 is attached nonreleasably at either end to the floorboard and/or to the seat receptacle, and is configured to retain a cushion or other seating surface against the floorboard. Further description of floorboard 500 is provided below (see FIGS. 15 and 16).

Figure 6:
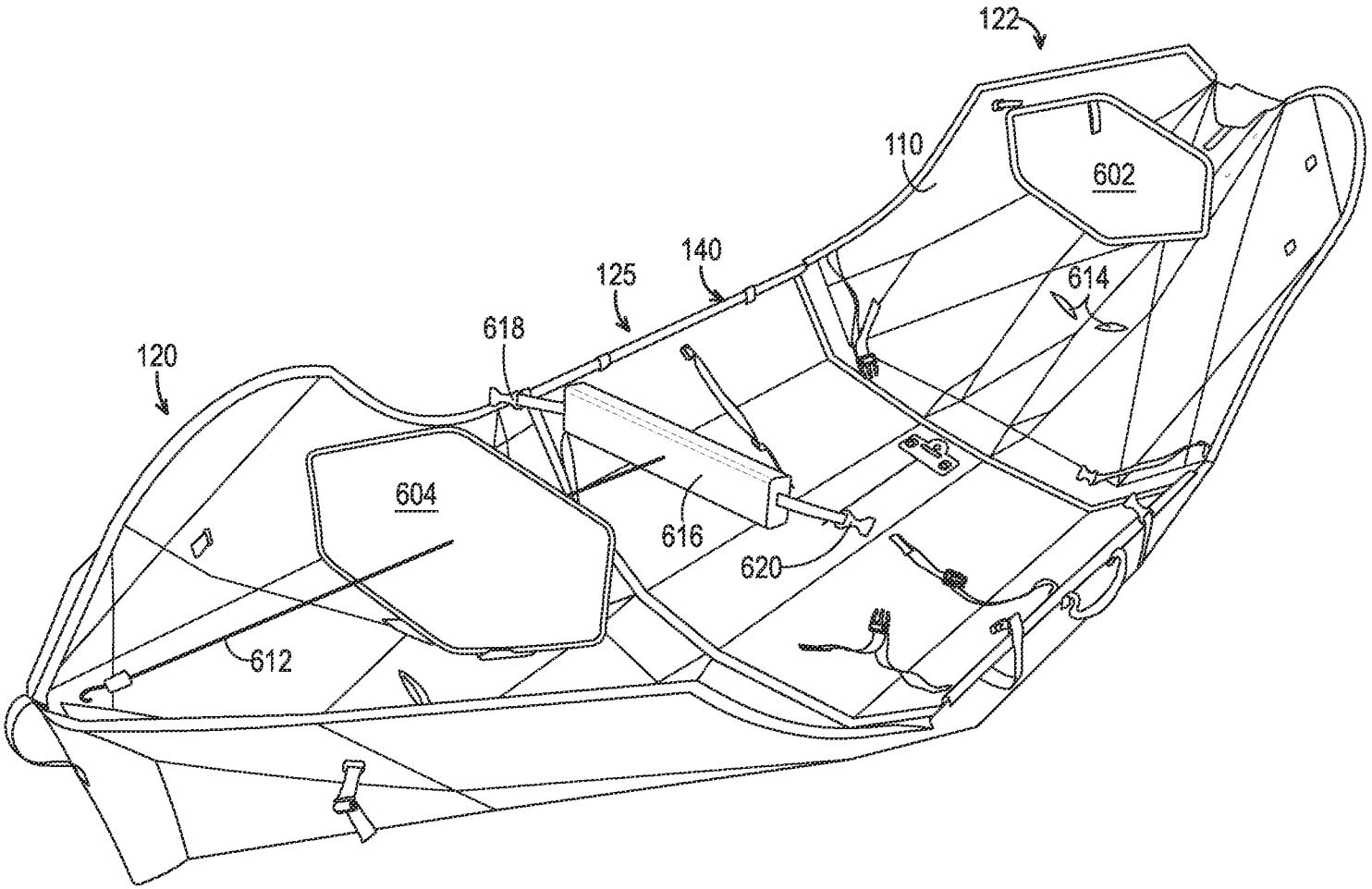
FIG. 6 is a perspective view of the watercraft of FIG. 1 showing bulkheads and a footrest.

As shown in FIG. 6, a stern bulkhead 602 is releasably secured in stern portion 122 to increase the structural integrity of the stern portion. Stern bulkhead 602 comprises a planar expanse or sheet having a size and shape substantially equal to a cross-sectional shape of stern portion 122 when the kayak is in its deployed state. This allows stern bulkhead 602 to be installed in stern portion 122 in an orientation generally transverse to longitudinal axis 117. Edges of the bulkhead are configured to contact inner walls of the stern portion, thereby structurally supporting the kayak and tending to prevent water ingress behind the bulkhead.

With continued reference to FIG. 6, a bow bulkhead 604 is installed in bow portion 120. Bow bulkhead 604 is releasably secured in bow portion 120 when the kayak is in its deployed state, to provide structural support to the bow portion. In some examples, bow bulkhead 604 and stern bulkhead 602 have different shapes and sizes. This enables bow bulkhead 604 to be installed farther from midship portion 125 than is stern bulkhead 602, e.g., providing room for the legs of a user in cockpit 140. In other examples, however, the bow bulkhead and the stern bulkhead may be equidistant from midship portion 125, and in general the bulkheads may be configured to be positioned at any desired locations. More or fewer of each of stern bulkhead 602 and bow bulkhead 604 may be included in watercraft of the present disclosure.

As shown in FIG. 6, bow bulkhead 604 is tethered to foldable sheet 110 using a cable 612 passing through an aperture in the bulkhead. In this example, stern bulkhead 602 is removably engaged to foldable sheet 110 by receiving slots 614. Receiving slots 614 hold stern bulkhead 602 perpendicular to longitudinal axis 117, such that, when kayak 100 is in the deployed state, rear outer panel 160 and rear gunwale panel provide inward pressure and retaining the stern bulkhead in position. In some examples, the stern bulkhead and/or the bow bulkhead may be nonreleasably attached to the sheet.

Cable 612 may be connected to a footrest 616 formed as a block, strap, or other suitable member configured to receive the feet of a user. Footrest 616 is removably attached to the hull via two buckles 618, 620 at outboard ends of the footrest. In some examples, footrest 616 is nonreleasably attached to the hull. Buckles 618, 620 may be adjustably engaged to the straps, such that the straps may be tightened after kayak 100 has been transitioned to the deployed state, e.g., to tighten the shape of the hull.

Figure 7:
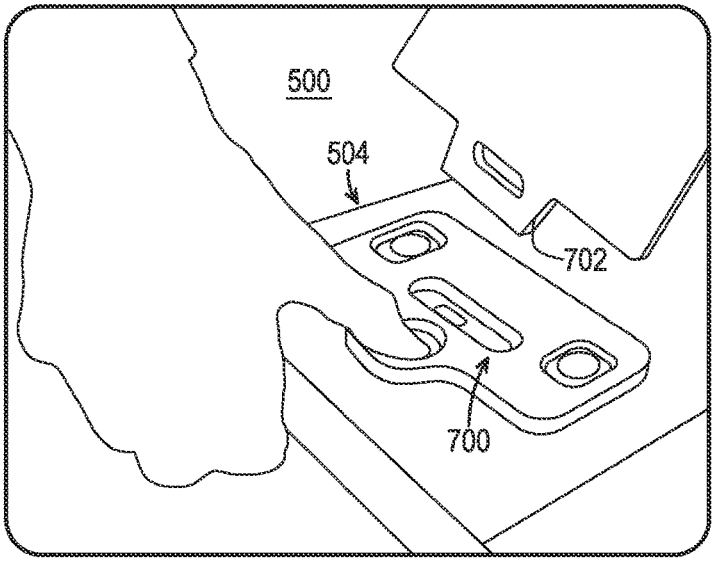
FIG. 7 is a perspective view of a seat receptacle suitable for use with watercraft of the present disclosure.

As shown in FIG. 7, seat receptacle 504 is disposed on floorboard 500 (e.g., by one or more screws, bolts, stitches, staples, nails, adhesives, and/or other fasteners). Seat receptacle 504 includes a slot 700 configured to receive a complementary attachment portion 702 (e.g., a tab or hook) of a seat (see FIG. 8 and seat 800 below).

Attachment portion 702 is configured to clip into slot 700 to be retained in seat receptacle 504. In this example, seat receptacle 504 has a spring-loaded latch to retain the attachment portion of the seat.

Figure 8:
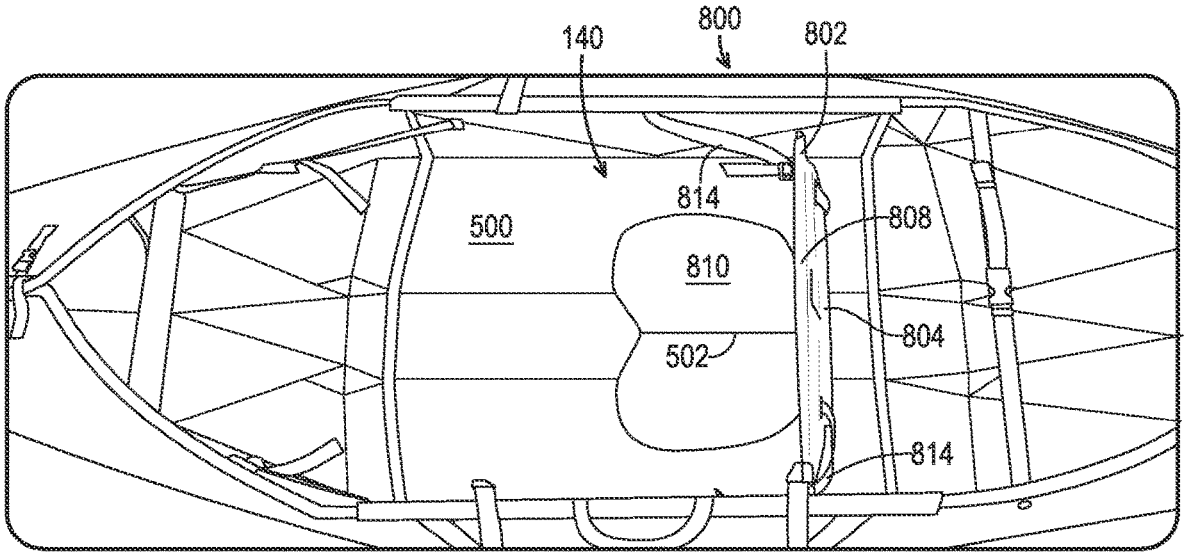
FIG. 8 is top plan view of an illustrative cockpit portion of a collapsible watercraft in accordance with the present teachings.

As shown in the top plan view of FIG. 8, a seat assembly 800 may be removably installed in kayak 100. Seat assembly 800 includes a seatback 802, which is installed in seat receptacle 504 of floorboard 500. Seatback 802 includes a seat column 804 coupled to a seat backrest 808. Seat backrest 808 is configured to support the back of a user sitting in cockpit 140. Seat column 804 is configured to support seat backrest 808 at a suitable height above cockpit floor 152. In some examples, seat column 804 is adjustable, enabling a user to set seat backrest 808 to variable heights.

Seat assembly 800 further includes a seating support surface 810, which is installed forward of seat receptacle 504, such that an occupant can sit on seating surface 810 and lean back against seat back 802. Seating surface 810 is retained against floorboard 500 by elastic cord 502, and/or any suitable retention device. Seating surface 810 is installed in kayak 100 by sliding the seating surface under elastic cord 502. Seating surface 810 may include any cushioned or uncushioned surface suitable for supporting an occupant in a seated position. In some examples, seating surface 810 is omitted.

Respective straps 814 are attached to the port and starboard sides of seat backrest 808. Strap 814 is coupled to the hull, (e.g., by stitching, screws, adhesive, rivets, and/or other fasteners). In some examples, another suitable seating surface may be used, for example a raised bench, a webbed sling, etc.

Figure 9:
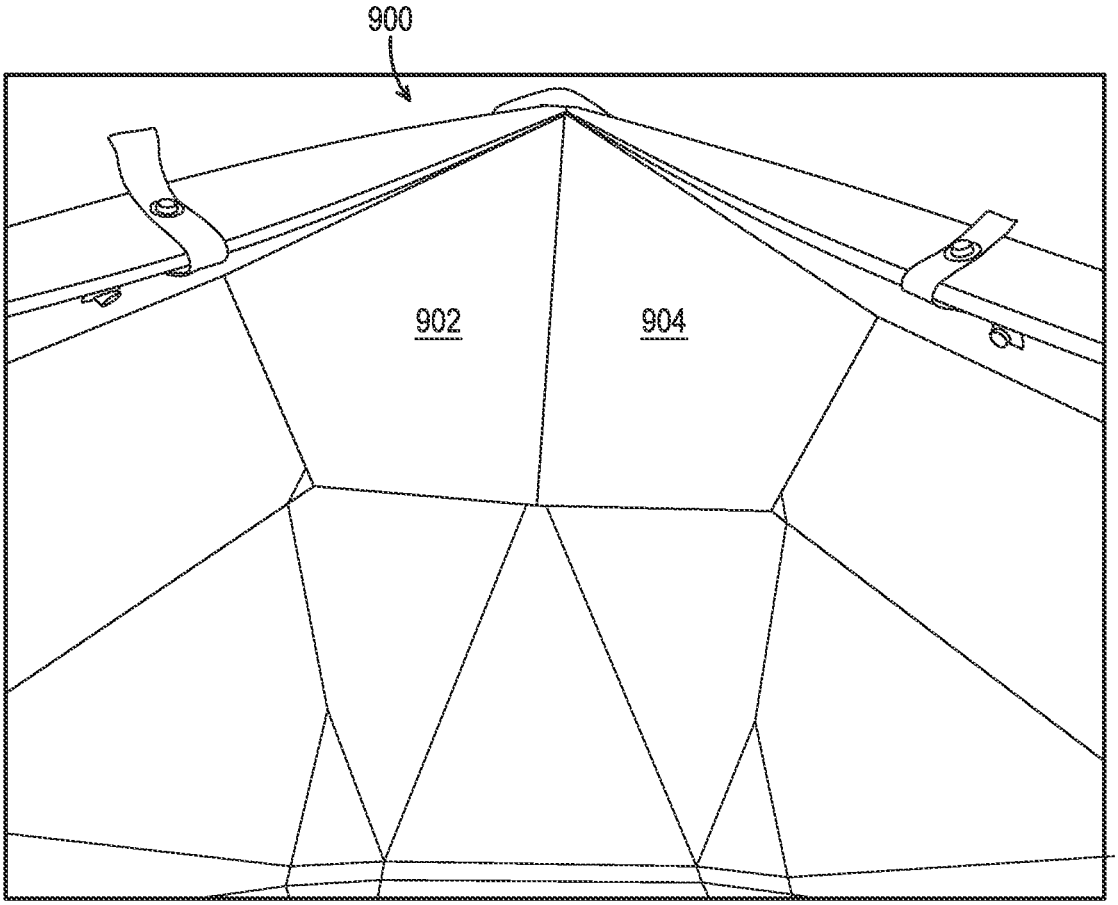
FIG. 9 is a perspective view of an illustrative folding bulkhead suitable for use with collapsible watercraft of the present disclosure.
Figure 10:
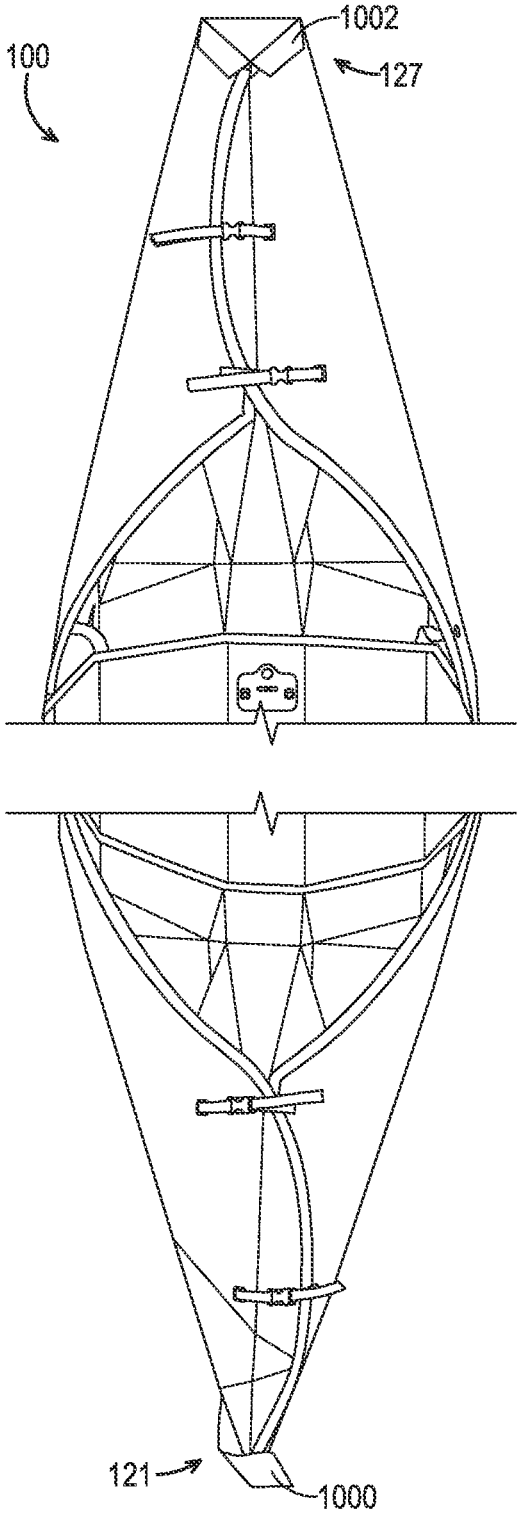
FIG. 10 is a top plan view of the watercraft of FIG. 1.

FIG. 9 depicts an alternative version of a bulkhead suitable for use with kayak 100 (either instead of or in addition to bulkheads 602 and/or 604). A built-in, collapsible bulkhead assembly 900 may be utilized with kayak 100 in the bow portion 120, stern portion 122, or both. In the example depicted in FIG. 9, bulkhead assembly 900 includes a pair of swinging half-bulkheads 902, 904, pivotably coupled to the sides of the kayak. In some examples, bulkhead assembly 900 include additional or fewer partial bulkheads. Half-bulkheads 902, 904 are each nonreleasably coupled to foldable sheet 110 by a respective hinge. Having complementary forms, half-bulkheads 902, 904 are configured to span the corresponding fore or aft space within the hull completely when extended into contact with each other.

When kayak 100 is in the stowed state, each half-bulkhead 902, 904 is configured to fold flat against an inner surface of flexible sheet 110. When transitioning kayak 100 to the deployed state, a user pivots half-bulkheads 902, 904 until distal edges of the half-bulkheads come into contact with each other. At that point, the user presses the half-bulkheads away from the cockpit (i.e., forward or aft) and into planar alignment with each other, thereby tensioning half-bulkheads 902, 904 together and forming a complete bulkhead.

Figure 11:
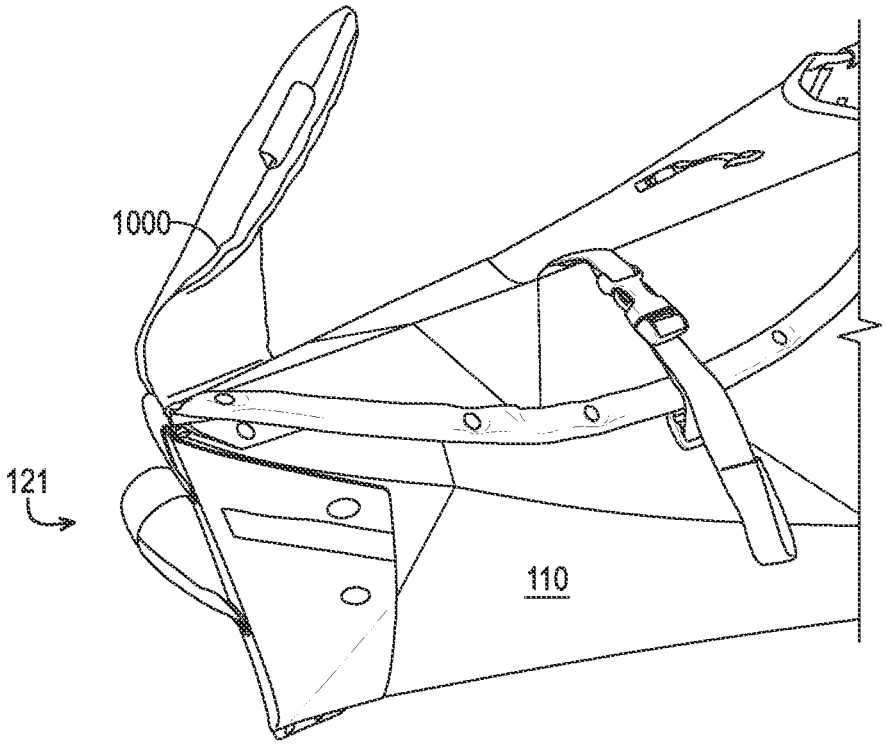
FIG. 11 is a perspective view of a bow portion of the watercraft of FIG. 1.

As shown in FIGS. 10-14, prow 121 and transom 127 are covered by respective fairings 1000 and 1002. Prow 121 at the bow end and transom 127 at the stern end are permanently closed. For example, prow 121 forms a V-shaped front end of the bow which is configured to cut through the water, and this V-shaped portion is formed by permanently attached segments, which may be connected together or formed together as a single piece. To protect prow 121, fairing 1000 is placed over the prow and attached thereon, as shown in FIG. 11. Fairing 1000 may be nonreleasably attached to the outer surface of flexible sheet 110 (e.g., with rivets, screws, stitching, adhesive, etc.).

Figure 12:
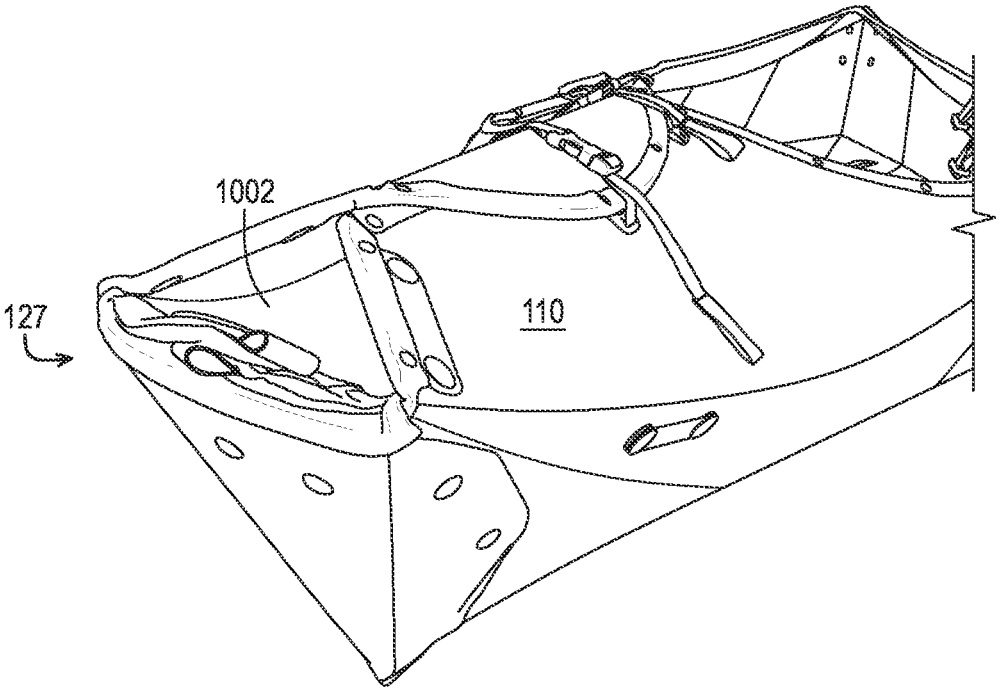
FIG. 12 is a perspective view of a stern portion of the watercraft of FIG. 1.
Figure 13:
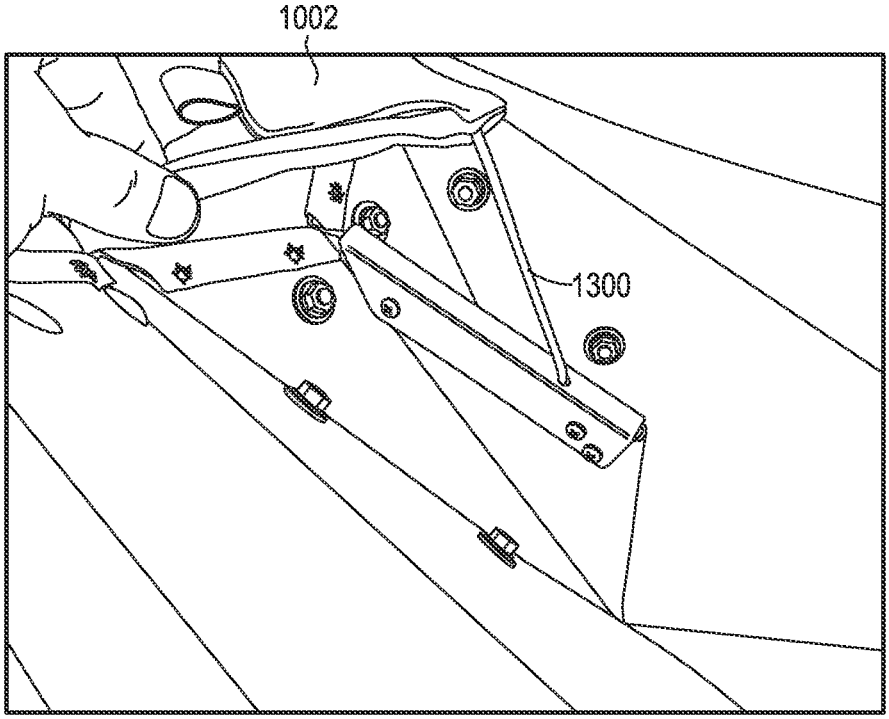
FIG. 13 is a rear perspective view of an illustrative fairing suitable for use on the stern portion of the watercraft of FIG. 1.
Figure 14:
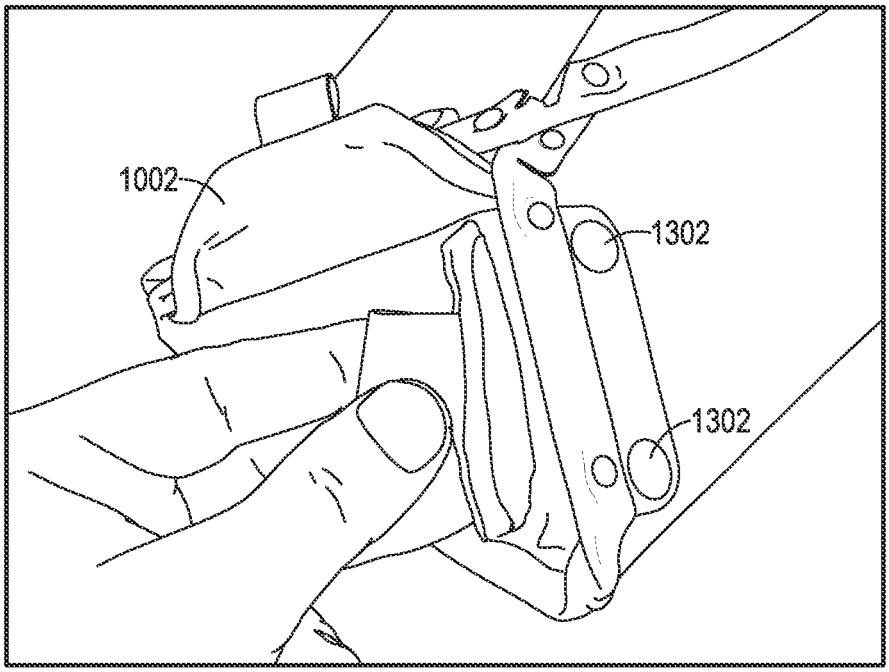
FIG. 14 is a front perspective view of the fairing of FIG. 13.

FIG. 12 depicts a space formed in the stern portion of kayak 100 when the kayak is in the deployed state. As shown in FIG. 13, fairing 1002 is brought from within the hull, astern through the space. Fairing 1002 may be attached to an interior fin within the stern portion by a cable 1300. As shown in FIG. 14, fairing 1002 is closed by connecting fasteners 1300 to receiving points 1302. Cable 1300 provides tension to fairing 1002 after the fairing is brought into a closed state.

Figure 15:
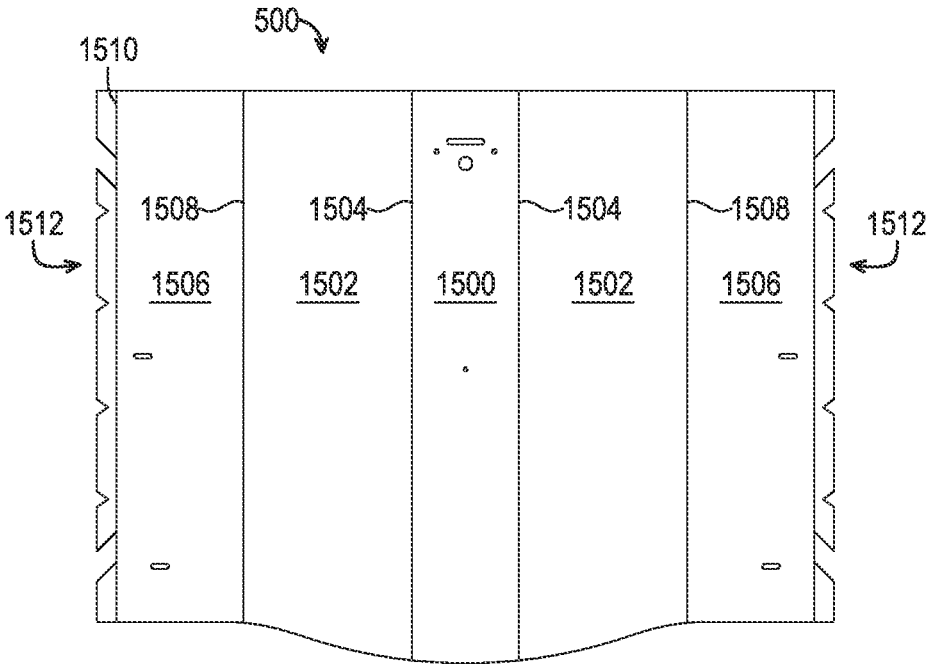
FIG. 15 is a top plan view of an illustrative floorboard suitable for use with the watercraft of FIG. 1.

FIG. 15 is top plan view of floorboard 500 in a flattened state. Floorboard 500 has a medial portion 1500 and a pair of inner lateral portions 1502 each connected to a respective side of medial portion 1500 at an inner lateral fold line 1504. Floorboard 500 additionally includes a pair of outer lateral portions 1506 connected to a respective inner lateral portion 1502 at an outer lateral fold line 1508. For illustrative purposes, FIG. 15 depicts the inner and outer lateral portions in a position substantially coplanar with medial portion 1500. However, the inner lateral portions are generally angled relative to the medial portion when the kayak is in the deployed state. Similarly, the outer lateral portions are generally angled relative to the inner lateral portions when the kayak is in the deployed state.

Floorboard 500 is configured to be permanently coupled to cockpit 140 (see FIG. 1), and is generally shaped to at least partially conform to the shape of cockpit floor 152. In the present example, inner lateral fold lines 1504 are substantially parallel to each other, to outer lateral fold lines 1508, and to lateral edges 1510. Any suitable number, shape, and arrangement of fold lines may be included in the floorboard. Lateral edges 1510 include an engagement profile 1512 for securing to the gunwales.

In the example depicted in FIG. 15, medial portion 1500 has a curved forward edge and is longer than the other portions of the floorboard. Additionally, inner lateral portions 1502 have complementarily sloped forward edges configured to continuously connect the forward edge of medial portion 1500 to the respective flat forward edge of outer lateral portions 1506. In some examples, medial portion 1500, inner lateral portions 1502, and outer lateral portions 1506 may be substantially rectangular. Accordingly, floorboard 500 has substantially similar width at a fore end and at an aft end. However, the floorboard may have any suitable shape (e.g., triangular, tapered, rhomboid, trapezoid, etc.).

Floorboard 500 may comprise any material suitable for supporting one or more kayak occupants, providing structure to the kayak cockpit, and/or folding along the fold lines described above. In some examples, floorboard 500 comprises a corrugated sheet of a suitable thermoplastic polymer, such as a heavy-duty corrugated polypropylene. In some examples, floorboard 500 has a thickness in the range of 5 millimeters (mm) to 15 mm. In some examples, floorboard 500 is 8 mm to 10 mm thick.

Figure 16:
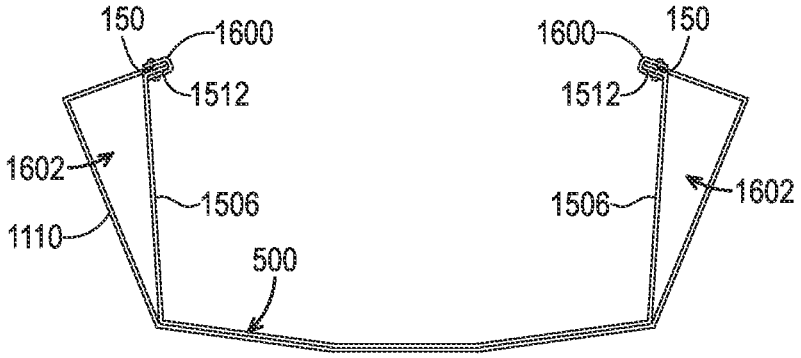
FIG. 16 is a sectional view of a cockpit portion of the watercraft of FIG. 1.

As shown in FIG. 16, floorboard 500 is permanently attached at engagement profile 1512 to cockpit flaps 150 via engagement members 1600. Each engagement member 1600 comprises a longitudinally extending clamp comprising plastic, metal, polymer, and/or any other suitable rigid or semirigid material. As shown in FIG. 16, the outer lateral portions 1506 have a larger vertical height than the midship portions of body 112. When kayak 100 is in the deployed state, this creates space 1602. Due to the space created from the geometry of the floorboard and the flexible sheet, in concert with the unreleasable attachment between the floorboard and the flexible sheet, when the kayak is in the stowed state, the floorboard creates an accommodating space for accessories (see further description below).

Figure 17:
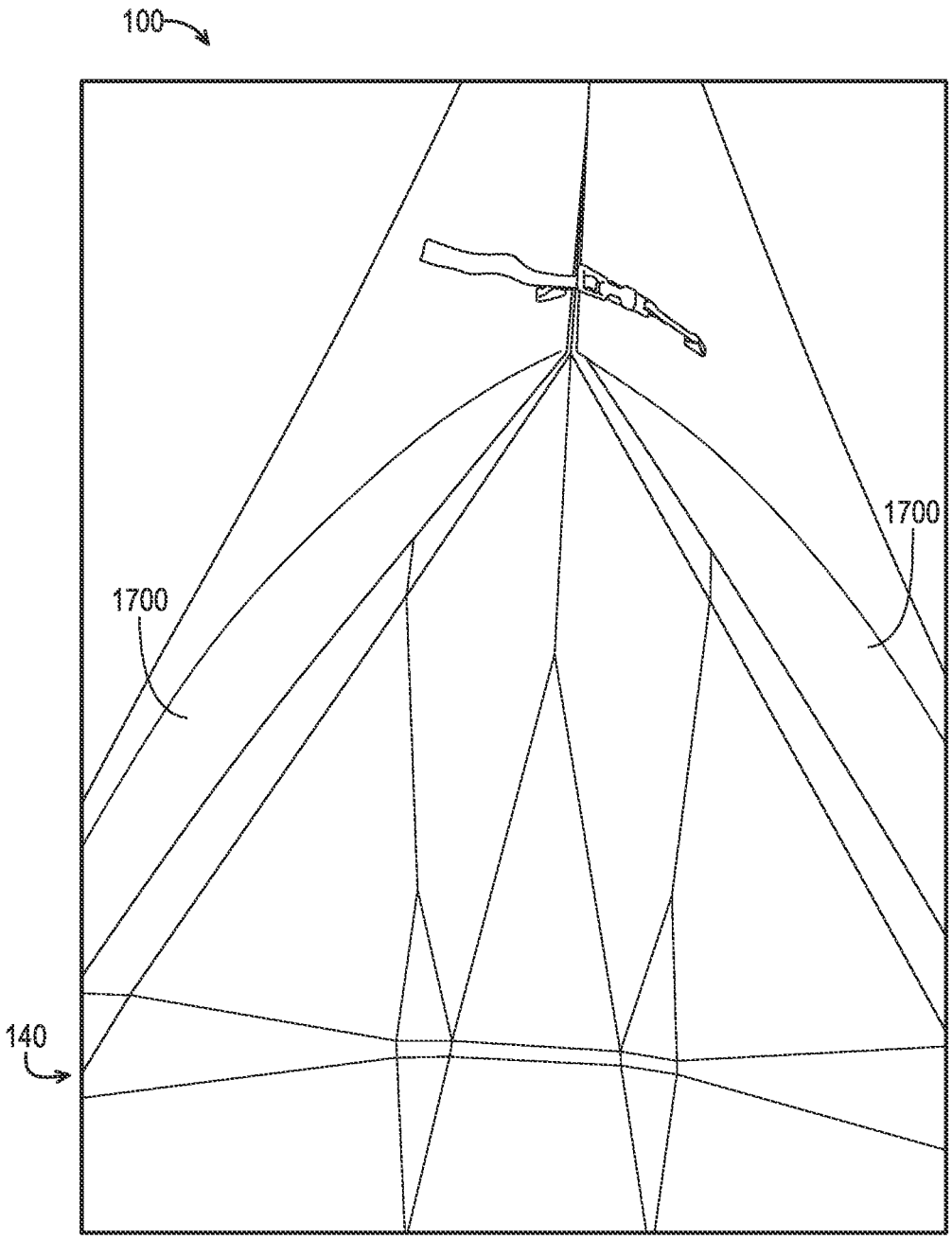
FIG. 17 is a top plan view of a forward portion of a gunwale of the cockpit of the watercraft of FIG. 1, depicting a curved edge.
Figure 18:
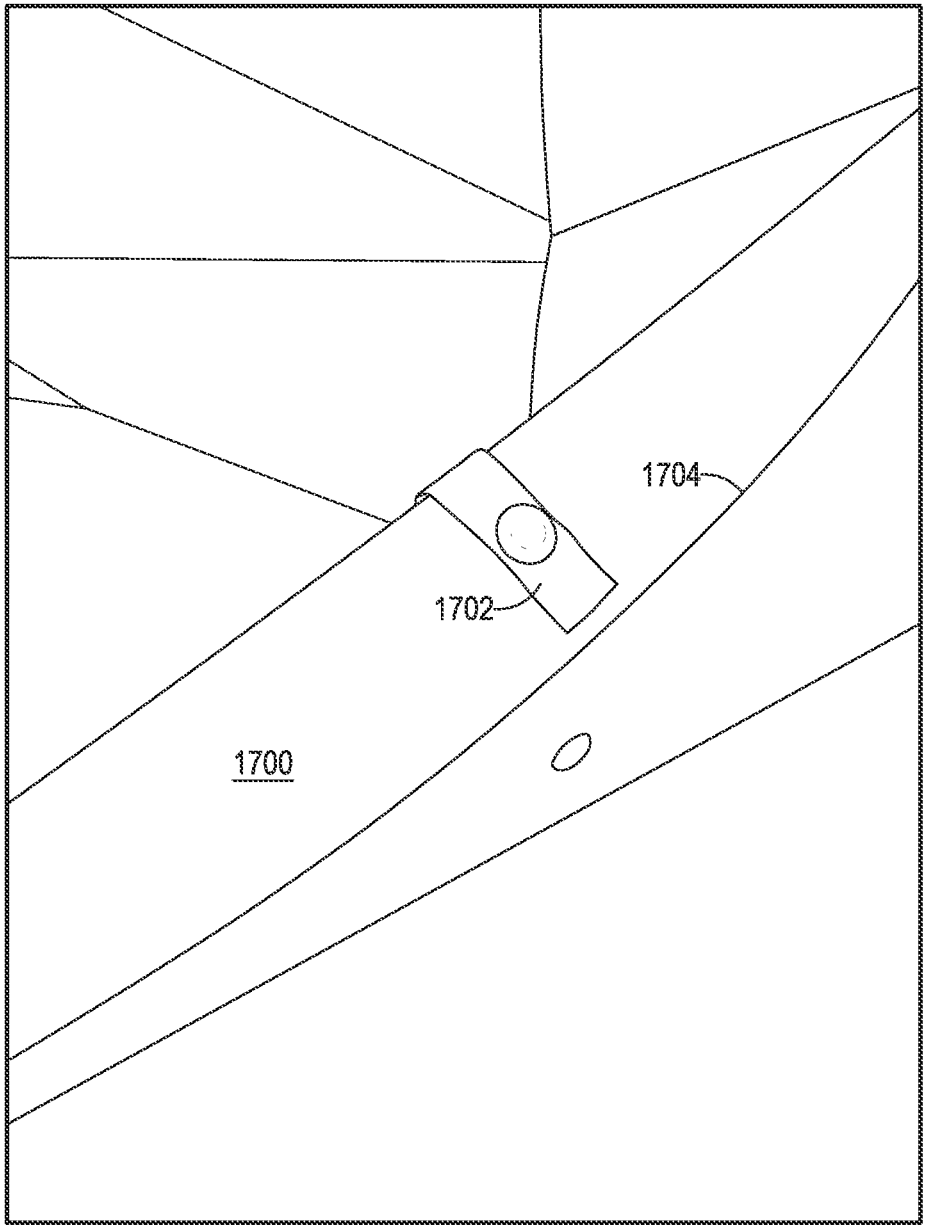
FIG. 18 is a perspective view of a portion of the curved edge of FIG. 17.

As shown in FIG. 17, curved gunwale panels 1700 may be utilized in some embodiments of kayak 100, e.g., replacing or supplementing front gunwale panel 172. In the example shown in FIG. 17, curved gunwale panels 1700 are disposed at the front (i.e., forward end) of cockpit 140. In some examples, curved gunwale panels 1700 may be disposed at the aft end of cockpit 140 and/or may form all gunwales surrounding cockpit 140.

When transitioning kayak 100 to the deployed configuration, curved gunwale panels 1700 are configured to be folded by a user in an inboard direction. These panels are folded along a curved fold line 1704, such that the edge of the panel then points in a generally inboard direction and the hull is bowed out slightly. Fastener 1702 is configured to retain curved gunwale panels 1700 in this folded state for the duration of use of kayak 100. Fastener 1702 is depicted as a strap and a snap or button, though other releasable fasteners may be utilized. By folding curved gunwale panels 1700 into place and fastening, elastic tension is formed in foldable sheet 110, reinforcing the resilience of the gunwale and hull of the kayak. When transitioning kayak 100 to the stowed state, the user disengages fastener 1702, thereby releasing the tension, and unfolds the panel.

Figure 19:
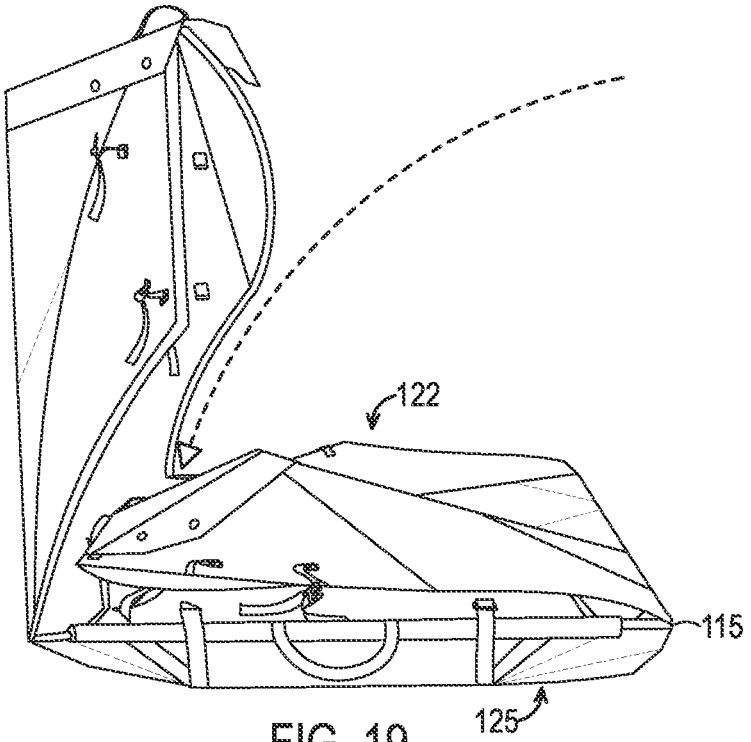
FIG. 19 is a perspective view of the watercraft of FIG. 1 in a partially folded state depicting an illustrative step of folding from a deployed state to a stowed state.
Figure 20:
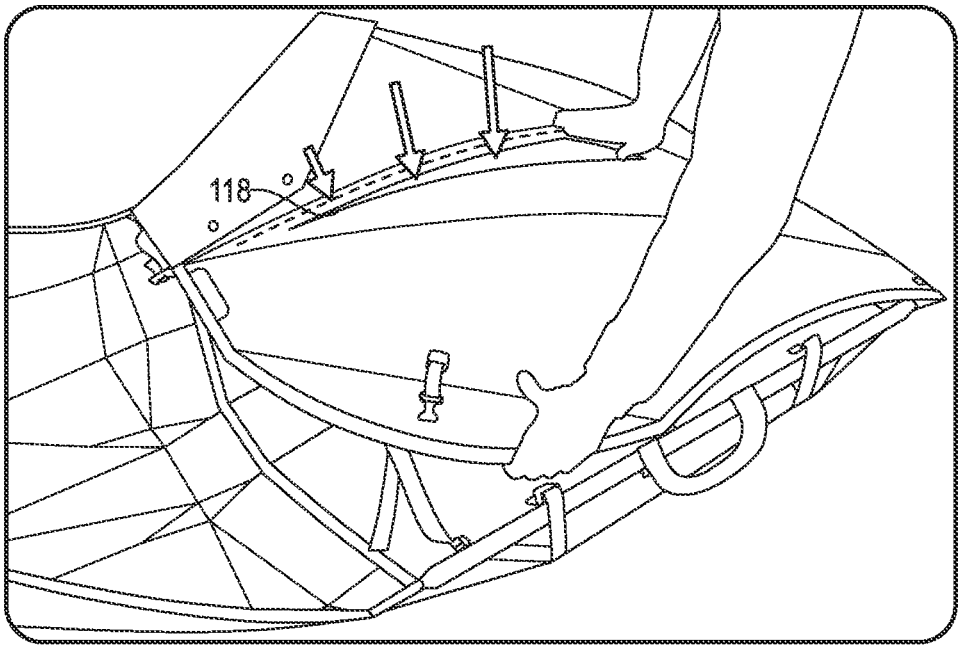
FIG. 20 is a perspective view of the watercraft of FIG. 1 in a partially folded state depicting an illustrative step of folding from a deployed state to a stowed state.
Figure 21:
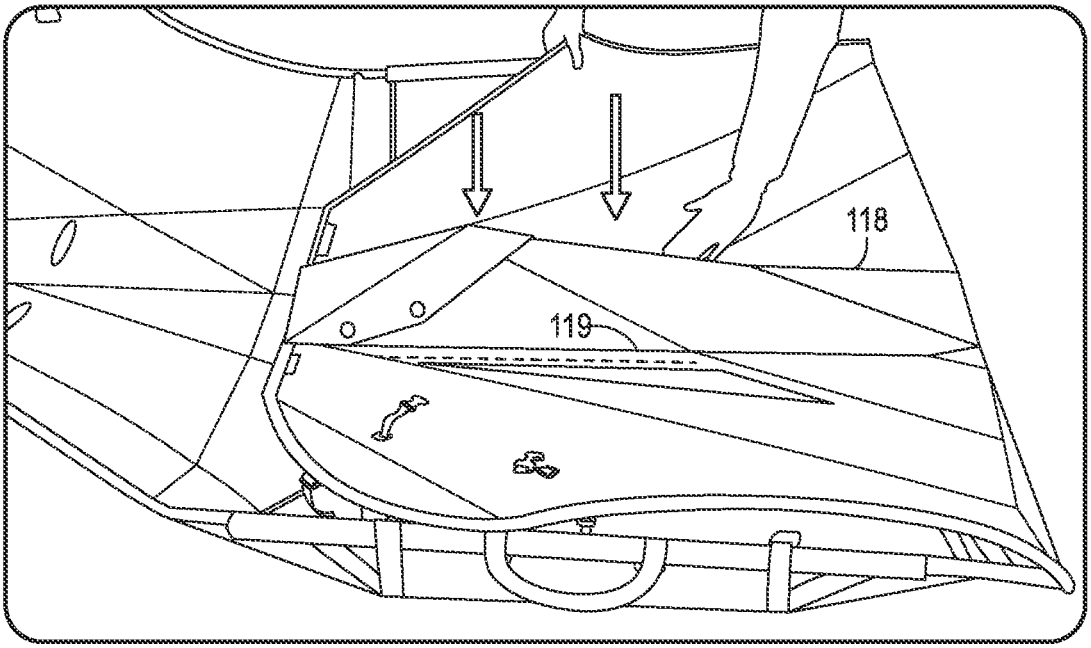
FIG. 21 is a perspective view of the watercraft of FIG. 1 in a partially folded state depicting an illustrative step of folding from a deployed state to a stowed state.

FIGS. 19-27 depict various stages of transitioning kayak 100 to the stowed state. First, a user disengages straps and/or fasteners (e.g., straps 618, 620, strap 814, etc.) and removes removable components, such as seat assembly 800. This leaves kayak 100 in a partially disassembled state, as shown in FIG. 5. As shown in FIG. 19, stern portion 122 is folded onto midship portion 125 along fold lines 115 as indicated by the arrow. As shown in FIGS. 20 and 21, stern portion 122 is collapsed by pressing fold lines 118, 119 downward, as indicated by the arrows. This collapses deck portions 126 and 132 on the stern side inward.

Figure 22:
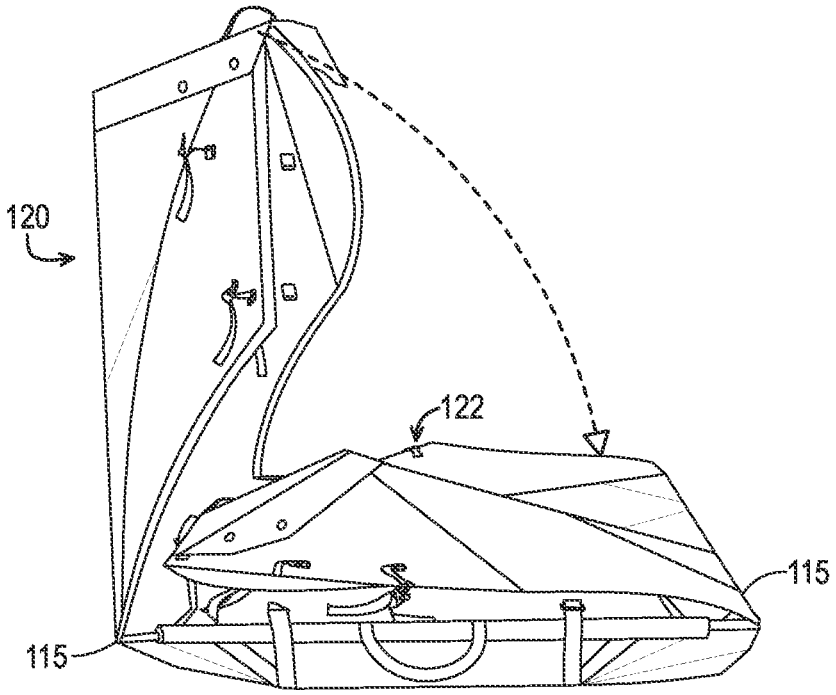
FIG. 22 is a perspective view of the watercraft of FIG. 1 in a partially folded state depicting an illustrative step of folding from a deployed state to a stowed state.
Figure 23:
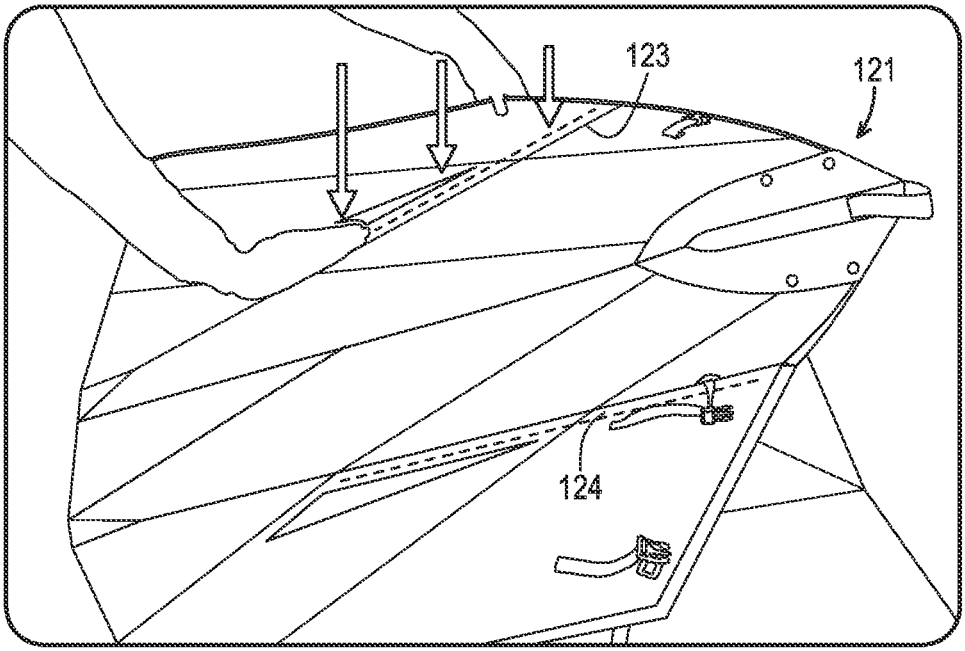
FIG. 23 is a perspective view of the watercraft of FIG. 1 in a partially folded state depicting an illustrative step of folding from a deployed state to a stowed state.
Figure 24:
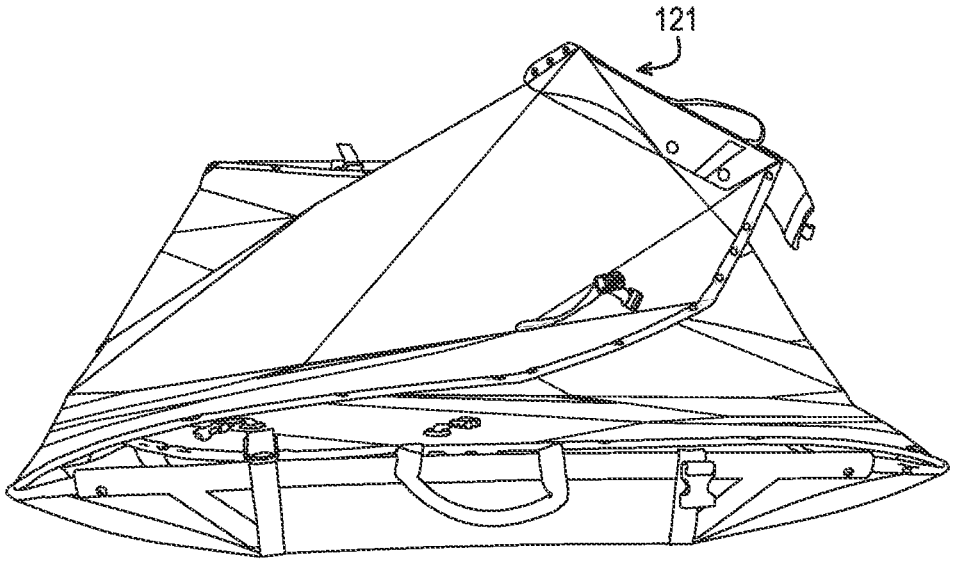
FIG. 24 is a side elevation view of the watercraft of FIG. 1 in a partially folded state.
Figure 25:
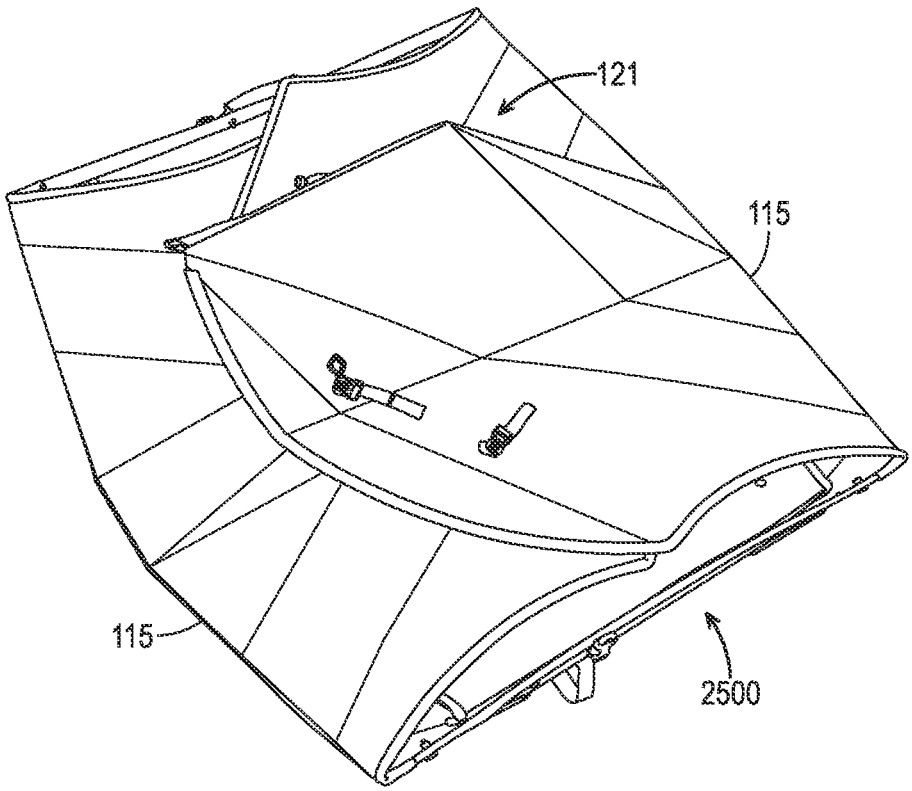
FIG. 25 is a perspective view of the watercraft of FIG. 1 in a partially folded state.

As shown in FIG. 22, bow portion 120 is then folded towards midship portion 125 and onto stern portion 122 as indicated by the arrow. As shown in FIG. 23, bow portion 120 is collapsed by pressing fold lines 123, 124 downward, as indicated by the arrows. Afterwards, prow 121 is left protruding upward as shown in FIG. 24. As shown in FIG. 25, prow 121 may be folded over to the side to facilitate later folding.

Figure 26:
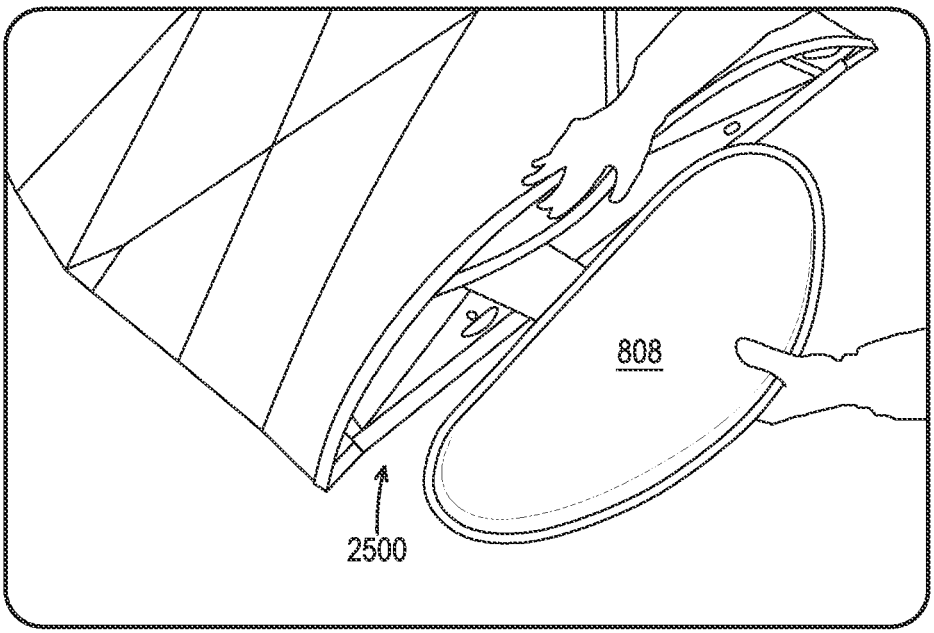
FIG. 26 is a perspective view of the watercraft of FIG. 1 in a partially folded state depicting an accommodation space.

As shown in FIG. 26, removable components (e.g., seat assembly 800, paddles, etc.) may be placed within accommodating space 2500 formed when kayak 100 is folded. Accommodating space 2500 is created by floorboard 500 as described above. In the stowed state, accommodating space 2500 provides the user with integrated storage space and protects stored components therein.

Figure 27:
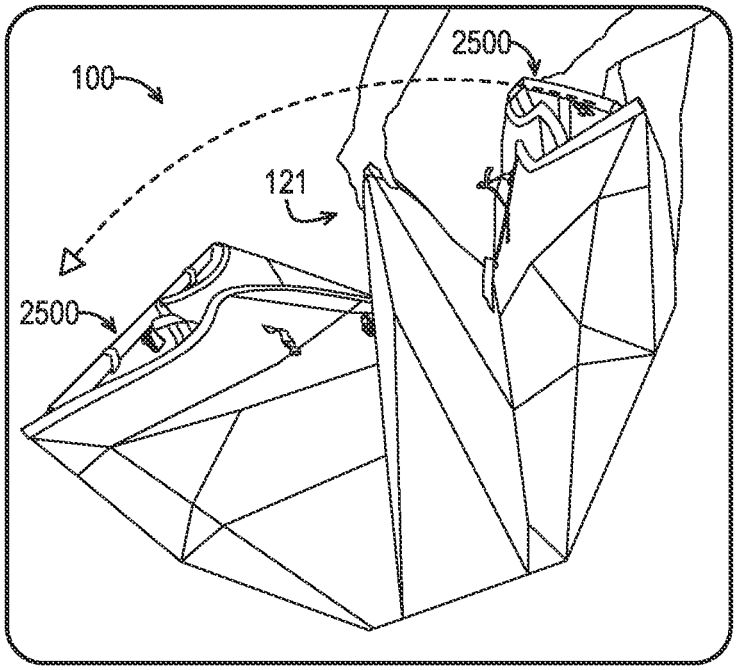
FIG. 27 is a perspective view of the watercraft of FIG. 1 in a partially folded state depicting an illustrative step of folding from a deployed state to a stowed state.

Finally, as shown in FIG. 27, kayak 100 may be folded laterally (i.e., orthogonal to longitudinal axis 117) forming portable box 300 (see. FIG. 3).

Figure 28:
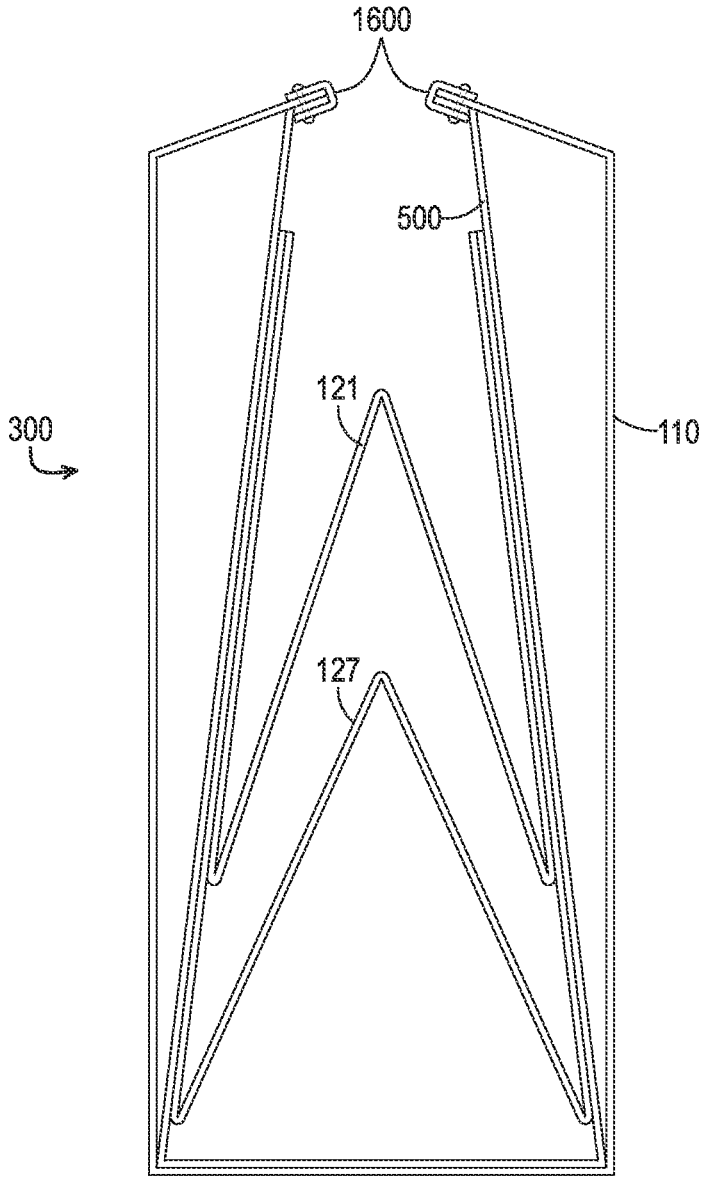
FIG. 28 is a sectional view of the watercraft of FIG. 1 in a stowed state.

As shown in the sectional view of FIG. 28, while kayak 100 is in the stowed state, the outboard surface of foldable sheet 110 forms the outermost structure of box 300. Floorboard 500 and any stored components (e.g., seat assembly 800, paddles, etc.) are disposed within box 300. This arrangement provides protection for components within box 300 and a convenient configuration for the user to carry kayak 100 and all necessary components.

Based on the above description, aspects and features of the collapsible watercraft are presented without limitation as a series of paragraphs below. Some of the paragraphs below expressly refer to and further limit other paragraphs, providing examples of suitable combinations.

AA. A collapsible kayak, comprising:

a single-piece hull including a plurality of crease lines along which the hull is foldable; and a floorboard lining a midship section of the hull, the floorboard including a base and a pair of outboard walls pivotably coupled to the base and permanently fixed at distal ends to port and starboard gunwales of the hull, respectively;

wherein the plurality of crease lines are configured such that bow and stern ends of the kayak are foldable toward each other to overlap the midship section of the hull when collapsed.

A0. A collapsible kayak, comprising:

a single-piece hull including a plurality of crease lines along which the hull is foldable; and a floorboard lining a midship portion of the hull between a bow portion and a stern portion, the floorboard including a base and a pair of outboard walls pivotably coupled to the base and permanently fixed at distal ends to port and starboard gunwales of the hull, respectively;

wherein the bow, stern, and midship portions are configured as a tri-fold, such that the bow portion and the stern portion of the kayak are foldable toward each other to overlap the midship portion of the hull when collapsed.

A1. The collapsible kayak of A0, wherein the port and starboard gunwales each comprise a folded flap.

A2. The collapsible kayak of A0 or A1, further comprising a bulkhead oriented athwartships in a first end portion of the hull.

A3. The collapsible kayak of A2, wherein the bulkhead is removably held in place by a tether coupled to the first end portion of the hull.

A4. The collapsible kayak of A2, wherein the bulkhead includes a pair of pivoting half-walls coupled at outboard ends to the hull, such that the half-walls are configured to meet at inboard ends to form the bulkhead when deployed and to be folded against the hull when collapsed.

A5. The collapsible kayak of any one of paragraphs A0 through A4, further comprising a seatback removably coupled to the base of the floorboard.

A6. The collapsible kayak of A0, further comprising a removable footrest coupled at opposing outboard ends to the hull.

A7. The collapsible kayak of any one of paragraphs A0 through A6, further comprising a closed prow, such that the prow maintains a three-dimensional shape when the kayak is deployed and when the kayak is collapsed.

A8. The collapsible kayak of any one of paragraphs A0 through A7, further comprising a closed transom, such that the transom maintains a three-dimensional shape when the kayak is deployed and when the kayak is collapsed.

B0. A collapsible watercraft, comprising:

a hull having a plurality of creases at which the hull is foldable to selectively deploy and collapse the watercraft;

a closed prow at a bow end of the hull and a closed transom at a stern end of the hull; and an integrated floorboard disposed at a midship section of the hull, at least a portion of the floorboard being permanently fixed to the hull;

wherein the bow end and the stern end of the kayak are foldable at respective creases forward and aft of the floorboard to overlap the midship section such that the closed prow and closed transom nest together over the floorboard.

B1. The collapsible watercraft of B0, wherein the floorboard comprises a base portion pivotably coupled to a pair of sidewalls, distal ends of the sidewalls being fixed respectively to port and starboard gunwales of the hull.

B2. The collapsible watercraft of B1, wherein the distal ends of the sidewalls are pinned to the hull at the gunwales.

B3. The collapsible watercraft of any one of paragraphs B0 through B2, further comprising a collapsible bulkhead configured to span the hull athwartships and close off one end of the watercraft.

B4. The collapsible watercraft of B3, wherein the collapsible bulkhead comprises a planar expanse removably coupled to an end of the watercraft by a tether.

B5. The collapsible watercraft of B3, wherein the collapsible bulkhead comprises a pair of partial walls pivotably coupled to the hull, wherein the partial walls are configured to form the bulkhead by pivoting into contact with each other when deployed and to pivot against the hull when collapsed.

B6. The collapsible watercraft of any one of paragraphs B0 through B5, further comprising a seatback coupled to the floorboard.

B7. The collapsible watercraft of B6, further comprising a footrest removably coupled at outboard ends to the hull, forward of the seatback.

B. Illustrative Method

Figure 29:
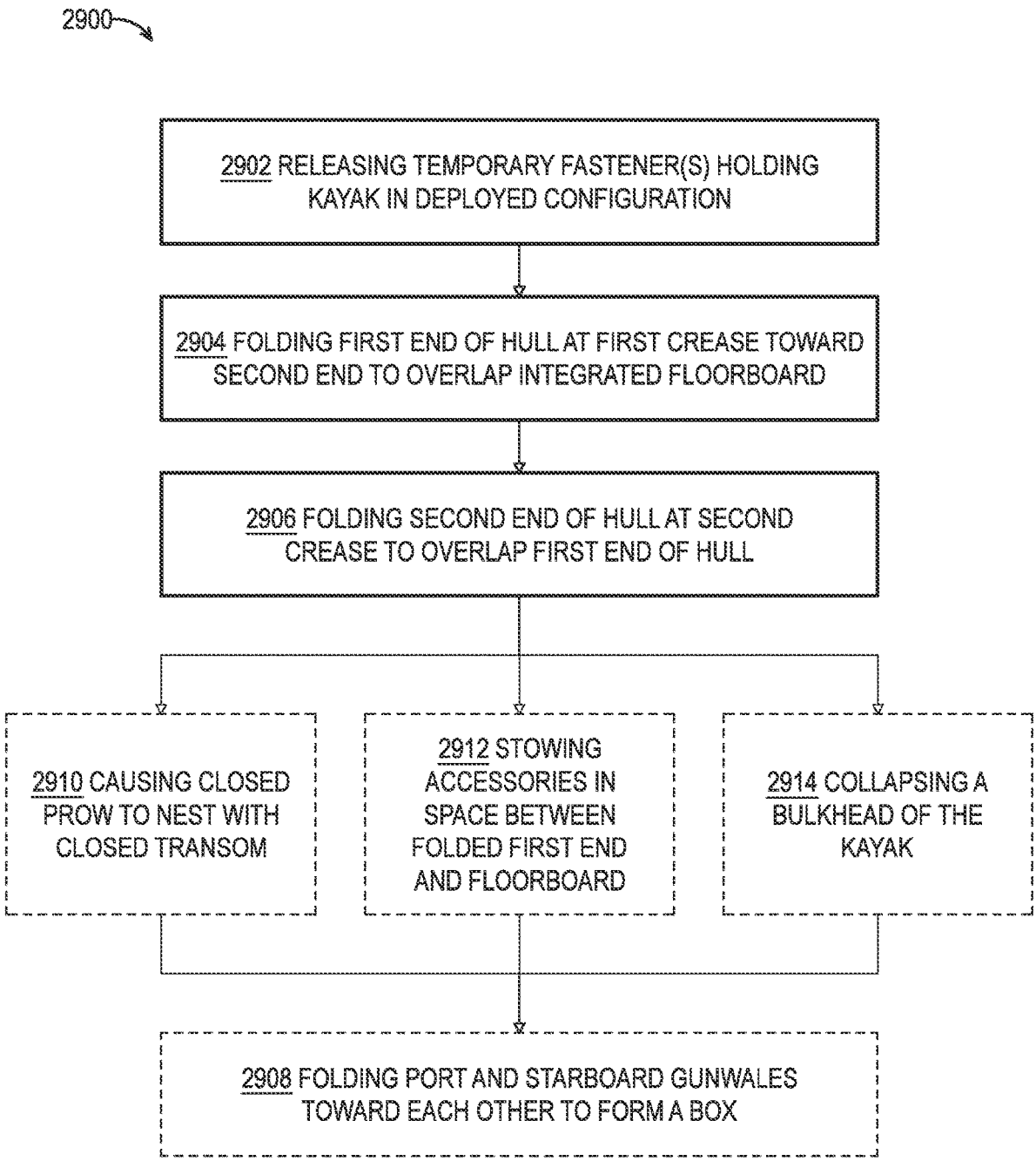
FIG. 29 depicts steps of a method for collapsing a collapsible watercraft in accordance with aspects of the present disclosure.

This section describes steps of an illustrative method 2900 for stowing a collapsible watercraft of the present disclosure; see FIG. 29. Aspects of kayak 100 described above may be utilized in the method steps described below. Where appropriate, reference may be made to components and systems that may be used in carrying out each step. These references are for illustration, and are not intended to limit the possible ways of carrying out any particular step of the method.

FIG. 29 is a flowchart illustrating steps performed in an illustrative method, and may not recite the complete process or all steps of the method. Although various steps of method 2900 are described below and depicted in FIG. 29, the steps need not necessarily all be performed, and in some cases may be performed simultaneously or in a different order than the order shown.

Step 2902 of method 2900 includes releasing one or more temporary fasteners holding a collapsible kayak in a deployed configuration to cause port and starboard gunwales of the kayak to be moveable in an outboard direction. In this example, the kayak has a midship section including an integrated floorboard fixed to an outer hull of the kayak at the port and starboard gunwales.

Step 2904 of method 2900 includes folding a first end of the hull of the kayak at a first crease toward a second end of the hull, such that the first end overlaps the integrated floorboard. In some examples, the first end is a bow end of the kayak and the second end is a stern end of the kayak.

Step 2906 of method 2900 includes folding the second end of the hull at a second crease to overlap the first end of the hull. In some examples, the floorboard is disposed between the first and second creases.

Step 2908 of method 2900 includes, after folding the first and second ends of the hull at the first and second creases, folding the port and starboard gunwales of the kayak toward each other to form a portable box.

In some examples, a prow at a bow end of the kayak is permanently closed, such that the prow maintains a same three-dimensional shape when the kayak is collapsed and when the kayak is deployed, and a transom at a stern end of the kayak is permanently closed, such that the transom maintains a same three-dimensional shape when the kayak is collapsed and when the kayak is deployed. Accordingly, in these examples, a step 2910 of method 2900 includes causing the prow and the transom to nest with each other when the first and second ends are folded to overlap the floorboard.

In some examples, a step 2912 of method 2900 includes stowing one or more accessories of the kayak between the folded-over first end of the kayak and the floorboard.

In some examples, a step 2914 of method 2900 includes collapsing a bulkhead of the kayak. In some examples, this step 2914 includes untethering a bulkhead of the kayak from the hull and removing the bulkhead from the kayak. In some examples, this step 2914 includes pivoting wall portions of the bulkhead against the hull.

Advantages, Features, and Benefits

The different embodiments and examples of the watercraft described herein provide several advantages over known solutions for providing a collapsible watercraft. For example, illustrative embodiments and examples described herein allow a deployed watercraft to collapse into an easily transportable box, in an intuitive tri-fold fashion.

Additionally, and among other benefits, illustrative embodiments and examples described herein have an increased freeboard.

Additionally, and among other benefits, illustrative embodiments and examples described herein allow an integrated bulkhead to be easily deployed and collapsed by a user.

Additionally, and among other benefits, illustrative embodiments and examples described herein allow an integrated floorboard configured to create an accommodation space for accessories and the like when the watercraft is collapsed.

No known system or device can perform these functions. However, not all embodiments and examples described herein provide the same advantages or the same degree of advantage.

Conclusion

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A collapsible kayak, comprising:

a continuous sheet forming a single-piece hull having a bow portion, a midship portion, and a stern portion, the single-piece hull including a plurality of crease lines, such that the single-piece hull is configured to be foldable; and a floorboard lining the midship portion of the single-piece hull between the bow portion and the stern portion, the floorboard including a base and a pair of outboard walls pivotably coupled to the base, the outboard walls being fixed to port and starboard gunwales of the single-piece hull, respectively;

wherein the outboard walls are configured to remain fixed to the port and starboard gunwales when the collapsible kayak is collapsed.

2. The collapsible kayak of claim 1, wherein the outboard walls are configured to form an accommodating space between the outboard walls and the port and starboard gunwales when the collapsible kayak is collapsed.

3. The collapsible kayak of claim 1, wherein the bow portion and the stern portion are foldable toward each other to overlap the floorboard when the collapsible kayak is collapsed.

4. The collapsible kayak of claim 1, wherein the bow portion, the midship portion, and the stern portion are configured as a tri-fold.

5. The collapsible kayak of claim 1, wherein a first outboard wall of the pair of outboard walls is permanently fixed to the port gunwale by a first engagement member, and wherein a second outboard wall of the pair of outboard walls is permanently fixed to the starboard gunwale by a second engagement member.

6. The collapsible kayak of claim 5, wherein the first and second engagement members each comprise an elongated clamp.

7. The collapsible kayak of claim 1, further comprising a closed prow, wherein the closed prow is configured to maintain a three-dimensional shape when the collapsible kayak is collapsed.

8. The collapsible kayak of claim 1, further comprising a closed transom, wherein the closed transom is configured to maintain a three-dimensional shape when the collapsible kayak is collapsed.

9. A collapsible watercraft, comprising:

a continuous sheet forming a single-piece hull having a plurality of creases, such that the single-piece hull is configured to be foldable to selectively deploy and collapse the collapsible watercraft, the continuous sheet comprising a first folded flap extending from a port gunwale of the single-piece hull and a second folded flap extending from a starboard gunwale of the single-piece hull;

an integrated floorboard disposed at a midship section of the single-piece hull, the integrated floorboard comprising a base portion pivotably coupled to a port sidewall and a starboard sidewall of the integrated floorboard, wherein the port sidewall comprises a first engagement profile and the starboard sidewall comprises a second engagement profile; and a first engagement member coupling the first folded flap to the first engagement profile and a second engagement member coupling the second folded flap to the second engagement profile; wherein the first and second folded flaps and the first and second engagement profiles are configured to remain coupled to each other when the collapsible watercraft is deployed and when the collapsible watercraft is collapsed.

10. The collapsible watercraft of claim 9, further comprising a closed prow at a bow end of the single-piece hull and a closed transom at a stern end of the single-piece hull.

11. The collapsible watercraft of claim 10, wherein the bow end and the stern end are foldable at respective creases forward and aft of the integrated floorboard to overlap the midship section such that the closed prow and closed transom nest together over the integrated floorboard.

12. The collapsible watercraft of claim 10, wherein the closed prow and the closed transom each maintain a three-dimensional shape when the collapsible watercraft is deployed and when the collapsible watercraft is collapsed.

13. The collapsible watercraft of claim 9, wherein the first and second engagement members each comprise a longitudinally extending clamp.

14. The collapsible watercraft of claim 9, wherein the port sidewall is configured to form an accommodating space between the port sidewall and the port gunwale when the collapsible watercraft is collapsed, and wherein the starboard sidewall is configured to form an accommodating space between the starboard sidewall and the starboard gunwale when the collapsible watercraft is collapsed.

15. A collapsible watercraft comprising:

a continuous sheet forming a single-piece hull having a bow portion, a midship portion, and a stern portion, wherein the continuous sheet has a plurality of creases, such that the single-piece hull is configured to be foldable to selectively transition the collapsible watercraft between a deployed configuration and a collapsed configuration; and an integrated floorboard lining the midship portion of the single-piece hull between the bow portion and the stern portion, wherein the integrated floorboard is fixed to port and starboard gunwales of the single-piece hull, respectively;

wherein the integrated floorboard is configured to remain fixed to the port and starboard gunwales when the collapsible watercraft is in the collapsed configuration, when the collapsible watercraft is in the deployed configuration, and when the collapsible watercraft is transitioning between the collapsed and deployed configurations.

16. The collapsible watercraft of claim 2, wherein the integrated floorboard includes a base and a pair of sidewalls pivotably coupled to the base, wherein the pair of sidewalls are fixed to the port and starboard gunwales of the single-piece hull, respectively.

17. The collapsible watercraft of claim 2, wherein the bow portion and the stern portion overlap the integrated floorboard when the collapsible watercraft is in the collapsed configuration.

18. The collapsible watercraft of claim 2, wherein an accommodating space is formed between the integrated floorboard and the port and starboard gunwales when the collapsible watercraft is in the collapsed configuration.

19. The collapsible watercraft of claim 15, further comprising a closed prow, wherein the closed prow is configured to maintain a three-dimensional shape when the collapsible watercraft is in the deployed configuration and when the collapsible watercraft is in the collapsed configuration.

20. The collapsible watercraft of claim 15, further comprising a closed transom, wherein the closed transom is configured to maintain a three-dimensional shape when the collapsible watercraft is in the deployed configuration and when the collapsible watercraft is in the collapsed configuration.

* * * * *